US006271817B1

(12) United States Patent
Wakai et al.

(10) Patent No.: US 6,271,817 B1
(45) Date of Patent: Aug. 7, 2001

(54) METHOD OF DRIVING LIQUID CRYSTAL DISPLAY DEVICE THAT REDUCES AFTERIMAGES

(75) Inventors: Yoichi Wakai; Kenji Niwa; Masanori Konishi; Yojiro Matsueda; Hiroaki Mikoshiba, all of Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/321,759

(22) Filed: May 28, 1999

Related U.S. Application Data

(63) Continuation of application No. 08/534,952, filed on Sep. 28, 1995, now abandoned, which is a continuation of application No. 08/179,388, filed on Jan. 10, 1994, now abandoned, which is a continuation-in-part of application No. 08/294,878, filed on Aug. 23, 1994, now Pat. No. 5,526,013, which is a continuation of application No. 07/855,605, filed on Mar. 20, 1992, now abandoned.

(30) Foreign Application Priority Data

| | | |
|---|---|---|
| Mar. 20, 1991 | (JP) | 3-57152 |
| Jun. 21, 1991 | (JP) | 3-150315 |
| Aug. 6, 1991 | (JP) | 3-196753 |
| Aug. 6, 1991 | (JP) | 3-196754 |
| Jan. 13, 1993 | (JP) | 5-4322 |
| May 26, 1993 | (JP) | 5-123964 |
| Jun. 18, 1993 | (JP) | 5-147779 |
| Jun. 21, 1993 | (JP) | 5-149552 |
| Oct. 23, 1993 | (JP) | 5-287789 |

(51) Int. Cl.[7] ..... G09G 3/36
(52) U.S. Cl. ..... 345/91; 345/94
(58) Field of Search ..... 345/87, 91, 89, 345/94, 93; 349/49, 50, 51, 52

(56) References Cited

U.S. PATENT DOCUMENTS 4,427,266 1/1984 Hosokawa .
4,560,982 12/1985 Sonehara et al. .

(List continued on next page.)

FOREIGN PATENT DOCUMENTS 0-367531 5/1990 (EP) .

(List continued on next page.)

OTHER PUBLICATIONS

Hiroaki Mikoshiba, "Reflective MIM Which Has Been Developed From Monochrome," *First Liquid Crystal Dis-*

(List continued on next page.)

*Primary Examiner*—Chanh Nguyen
(74) *Attorney, Agent, or Firm*—Oliff & Berridge, PLC

(57) ABSTRACT

The present invention relates to a method of driving an active-matrix type of liquid crystal display device that has a plurality of row electrodes to which a scanning signal is applied, a plurality of column electrodes to which a data signal is applied, and a plurality of picture elements (pixels) formed at a plurality of intersections between these row and column electrodes, each of these pixels comprising a liquid crystal layer and a two-terminal element having non-linear resistance characteristics connected in series therewith by means of applying a voltage of a difference signal between a scanning signal and a data signal to the pixels. A compensatory voltage is applied to each pixel immediately before a data write period during which the liquid crystal layer of the pixel is charged with a data charge voltage corresponding to a display gradation. This compensatory voltage is a voltage that charges the liquid crystal layer with a compensatory charge voltage of a polarity opposite to that of the data charge voltage. The relationship between the two voltages is such that when the magnitude of the data charge voltage is large, that of the compensatory charge voltage is small; when the magnitude of the data charge voltage is small, that of the compensatory charge voltage is large. This reduces the occurrence of afterimages that are caused by I-V characteristic shift in a non-linear two-terminal element.

44 Claims, 33 Drawing Sheets

U.S. PATENT DOCUMENTS

| | | |
|---|---|---|
| 4,730,140 | 3/1988 | Masubuchi . |
| 4,927,243 | 5/1990 | Taniguchi et al. . |
| 5,032,831 | 7/1991 | Kuijk . |
| 5,117,298 | 5/1992 | Hirai . |
| 5,159,325 | 10/1992 | Kuijk . |
| 5,247,376 | 9/1993 | Wakai . |
| 5,526,013 | 6/1996 | Ono et al. . |

FOREIGN PATENT DOCUMENTS

| | | |
|---|---|---|
| 0 394 903 | 10/1990 | (EP) . |
| 0-508628 | 10/1992 | (EP) . |
| 2 173335 | 10/1986 | (GB) . |
| 2187788 | 7/1990 | (JP) . |
| 2187789 | 7/1990 | (JP) . |
| 3-166514 | 7/1991 | (JP) . |
| 5-333819 | 12/1993 | (JP) . |

OTHER PUBLICATIONS play Seminar, Latest Trends in Portable Information Equipment: "Liquid Crystal Panels" and Panels for Portable Information Equipment Proposed by Liquid Crystal Manufacturers, Apr. 23, 1993, hosted by Nikkei BP, Japan.

Eishi Mizobata et al., "Reliable $SiN_x$ TFD–LDCs without Image Sticking," May 6–10, 1991, SID 87 Digest; pp. 226–307 and 54.

"Two–Terminal Device Addressed LCD", S. Togashi, *Optoelectronics Devices and Technologies*, vol. 7, No. 2, Dec. 1992, Tokyo JP, pp. 271–286.

FRX
ONE HORIZONTAL PERIOD
TA TB
Von
Va
-Va
Xm
Vp
Yn
-Vp
Vp+Va
Vp-Va
Toff B
TonB
2Va
0
-2Va
Xm-Yn
-(Vp-Va)
-(Vp+Va)
Toff A
TonA
DRIVE WITH DISPLAY CLOSE TO WHITE
DRIVE WITH DISPLAY CLOSE TO BLACK FIG. 29A
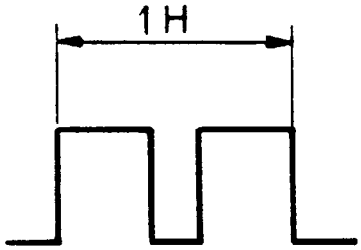
FIG. 29B
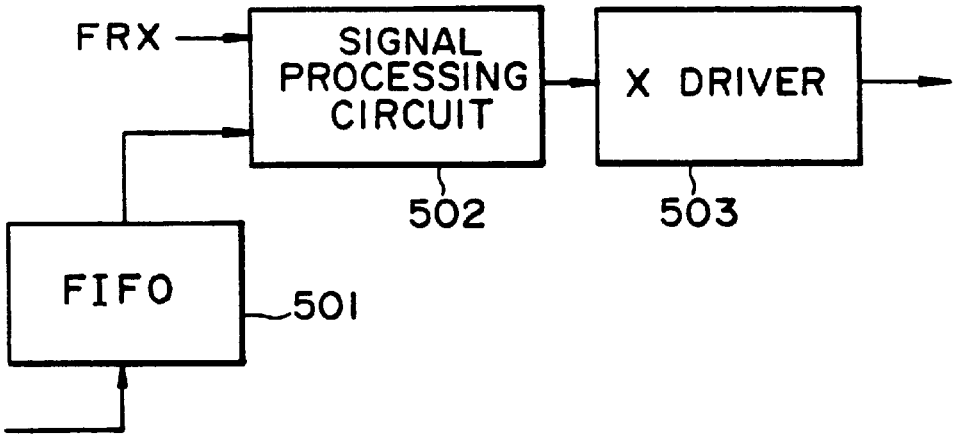
FIG. 29C
FIG. 29D
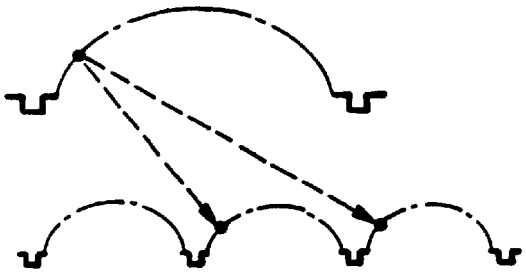

METHOD OF DRIVING LIQUID CRYSTAL DISPLAY DEVICE THAT REDUCES AFTERIMAGES

This is a Continuation of application Ser. No. 08/534,952 filed Sep. 28, 1995 ABN, which in turn is a Rule 62 Continuation of Ser. No. 08/179,388 filed Jan. 10, 1994 now abandoned and a Continuation-in-Part of Ser. No. 08/294,878 filed Aug. 23, 1994 now U.S. Pat. No. 5,526,013 which is in turn a Rule 62 Continuation of Ser. No. 07/855,605 filed Mar. 20, 1992 now abandoned. The entire disclosure of the prior applications is hereby incorporated by reference herein in its entirety.

BACKGROUND OF THE INVENTION

1. Field of the Invention

The present invention relates to a method of driving a liquid crystal display device and, in particular, to a method of driving an active-matrix liquid crystal display device utilizing a two-terminal element as a switching element of a pixel.

2. Related Art

An active-matrix type of liquid crystal display device provides a higher contrast than a conventional passive type of device, so they are becoming increasingly common in various manufacturing fields that use displays. Two types of active elements are used: two-terminal type and three-electrode type. The two-terminal type is considered to be superior from the economical point of view.

Some of the two-terminal type of active elements that are used are metal-insulator-metal (MIM) elements, ring diodes, and varistors.

In general, a two-terminal type of active element utilized in an active-matrix type of liquid crystal display device has the I-V characteristic shown in FIG. 3. In other words, it uses a switching function caused by a non-linear characteristic of current with respect to applied voltage, to charge and discharge an effective electrical charge applied to the picture element.

The configuration of an active-matrix liquid crystal display device using a two-terminal type of active element is shown in FIG. 1. In this figure, reference number 101 denotes a column drive circuit (X driver) that drives column electrodes of a liquid crystal panel 115, and 102 denotes a row drive circuit (Y driver) that drives row electrodes thereof.

In the X driver 101, reference number 104 denotes an AC video generation circuit which accepts a video signal (P) input, and generates an AC video signal in synchronization with an AC inversion signal FRX. Reference number 103 denotes a shift register that is activated by a shift start signal DX, performs a shift operation in synchronism with a shift clock signal XSCL, and sequentially generates a sampling signal Sm. Reference number 105 denotes a first analog switch that samples the AC video signal generated from the AC video generation circuit 104 by the sampling signal Sm and holds it in a capacitor 106. The capacitor 106 is a first sample-and-hold capacitor. Reference number 107 denotes a second analog switch that transfers the sampled video signal held in the capacitor 106 to another capacitor 108 by a latch pulse LP. The capacitor 108 is a second sample-and-hold capacitor. Reference number 109 denotes a buffer amplifier that drives a column electrode Xm on the basis of the video signal held in the capacitor 108.

Within the Y driver 102, reference number 110 denotes an inverter that uses Vp and −Vp as power sources and generates a selection voltage signal Vs in synchronization with an AC inversion signal FRY. Reference number 111 denotes a shift register that is activated by a shift start signal DY, performs a shift operation in synchronism with a shift clock signal YSCL, and generates a selection signal Cn. Reference number 112 denotes a power source selection switch for one cell of a drive circuit for a row electrode Yn.

The internal configuration of the selection switch 112 is shown in FIG. 2. The AC inversion signal FRY and selection signal Cn are input to shift register latches which consists of NOR gates 201 and 202. An output from the NOR gate 201 and an inverted signal obtained by an inverter 203 from the selection signal Cn are both input to AND gates 204 and 205, and outputs therefrom are input to gate electrodes of analog switches 207 and 208, respectively. The selection signal Cn is also input to a gate electrode of an analog switch 206. The selection voltage signal Vs and power sources −Va and Va are input to source electrodes of the analog switches 206 to 208, respectively, drain electrodes of the analog switches 206 to 208 are connected in common, and a signal Yn (a signal for driving the row electrode Yn) is output therefrom.

Reference number 115 denotes a liquid crystal panel. Column electrodes Xm and row electrodes Yn are formed on the respective substrates of the liquid crystal panel 115, and at each intersection thereof a non-linear element 114 and a liquid crystal layer 113 are arranged in series to form a pixel. In this case, voltages applied to the liquid crystal layer 113 and the non-linear element 114 are Vm and Vl, with respect to the row electrode.

The non-linear element 114 has the current-voltage characteristic shown in FIG. 3. As can be seen from this figure, when the applied voltage is small, the current is extremely small; when the applied voltage is large, the current characteristic increases steeply.

The operation of the example of a prior art liquid crystal display device shown in FIG. 1 and FIG. 2 will now be described with reference to the timing charts of FIG. 4 to FIG. 6.

As shown in FIG. 4, the video signal (P) is inverted in synchronization with the AC inversion signal FRX (when FRX=1, the phase of (P) is positive; when FRX=0, the phase of (P) is negative) to obtain an AC video signal 104. In this case, Va is the 100% white level of the positive-phase video signal and the 0% white level (pedestal level) of the negative-phase video signal, and −Va is the 0% white level (pedestal level) of the positive-phase video signal and the 100% white level of the negative-phase video signal. The shift start signal DY of the Y driver is sequentially transferred by the shift clock signal YSCL to generate selection signals C1, C2, C3 . . . Cn, . . . The latch pulse LP and the shift start signal DX of the X driver are input every horizontal scanning period.

An enlarged view of a specific horizontal scanning period is shown at the bottom of FIG. 4. The latch pulse LP is positioned roughly at the synchronization portion of the video signal, and it transfers the video signal that was sampled and held in the capacitor 106 during the previous horizontal scanning period to the capacitor 108. The shift start signal DX is positioned roughly at the start of the video signal portion in one horizontal scanning period, and it is transferred by the shift clock signal XSCL to generate sampling signals S1, S2, S3 . . . Sm, . . . For example, the nth video signal 104 sampled by sampling signal Sm (the sampling position marked by a circle (○) in the FIG. 4) is output to the column electrode Xm at the timing of the (n+1)th video signal after one horizontal scanning period.

FIG. 5 is a timing chart of the components shown in FIG. 2. According to logic combination of the selection signal Cn and the AC inversion signal FRY (in this prior art example, a common AC inversion signal is input to both the X driver and the Y driver—in other words, FRX=FRY), the outputs of the shift register latches 201 and 202 are made to repeatedly invert between 1 (Cn=1, FRY=0) and 0 (Cn=1, FRY=1). When Cn=1, Yn outputs the selection voltage signal Vs (which is at −Vp when FRY=1 or Vp when FRY=0); when Cn=0 (called the non-selection period or hold period), Yn outputs a voltage corresponding to the polarity at the immediately previous selection (when Cn=1)—i.e., it is Va after a positive (Vp) selection or −Va after a negative (−Vp) selection.

FIG. 6 is a timing chart of the column electrode signal Xm and the row electrode signal Yn, together with a difference signal Xm−Yn thereof. Video data which corresponds to the mth column in the horizontal direction along the liquid crystal panel 115 is sequentially sampled by the AC video signal, and is output as the line electrode signal Xm. The row electrode signal Yn outputs the selection voltage signal Vs during a selection period Ts, and a non-selection potential Va or −Va during a non-selection period Th. The non-selection potential after a selection at positive potential Vp is Va, and that after a selection at negative potential −Vp is −Va.

The difference signal Xm−Yn is shown as a solid line in the signal chart at the bottom of FIG. 6. In this case, the broken-line track is that of the potential at the connection between-the liquid crystal layer 113 and the non-linear element 114. Since a large voltage is applied to the non-linear element 114 during the selection period Ts, the current flowing therein is large, as can be understood from the I-V characteristic of FIG. 3, and the liquid crystal layer 113 is charged thereby. The amount of this electric charge is controlled by the amplitude of Xm−Yn during the selection period Ts or by the level of the column electrode signal Xm, i.e., by the level of sampling by the AC video signal 104. As described above, by changing the non-selection potential to match the polarity of the preceding selection potential, the signal level of the difference signal Xm−Yn is made positive in the non-selection period after a positive-polarity selection period, and negative in the non-selection period after a negative-polarity selection period. Therefore, the voltage applied to the non-linear element 114 in each non-selection period becomes small and thus it becomes difficult for the charge on the liquid crystal layer 113 to leak through the non-linear element 114 during the selection period. The effective voltage applied to the liquid crystal layer 113 is proportional to the shaded area in FIG. 6, and thus in effect depends on the level of the sampled video signal. The liquid crystal layer 113 controls the amount of light that passes through it in correspondence with the effective voltage applied to it, and thus a predetermined image is displayed on the liquid crystal panel 115.

However, two-terminal non-linear elements, especially MIM and metal-insulator-semiconductor (MIS) elements, experience a characteristic shift, as will be described below. As shown in FIG. 7, I-V1 denotes the initial current-voltage characteristic of a two-terminal non-linear element and I-V2 denotes the same characteristic that has shifted while a voltage was continuously applied to the element (refer to: E. Mizobata et al., SID91 Digest, p. 226 (1991)). In comparison with the I-V1 characteristic, the I-V2 characteristic shows that resistance increases when the voltage is high, which means that a reduced charge is written to the liquid crystal layer during the selection period. When the voltage is low, there is very little difference in resistance, which means that there is little difference in charge held in the liquid crystal layer during the non-selection period. It is known that this I-V characteristic shift saturates with voltage applied to the liquid crystal layer.

The effect of this I-V characteristic shift on the display will now be described with reference to the display of a white window against a black background, as shown in FIG. 8. Consider a pixel P1 that is displaying black at the intersection of column electrode Xm1 and row electrode Yn, and a pixel P2 that is displaying white at the intersection of column electrode Xm2 and row electrode Yn. When the entire screen changes to an an intermediate display, as shown in FIG. 9, the previous window display remains as an afterimage. In other words, pixel P1 ends up lighter than pixel P2. The reason for this will now be explained with reference to FIG. 10. Xm1−Yn denotes the signal applied to pixel P1 and Xm2−Yn denotes the signal applied to pixel P2. A voltage VmsW applied to the non-linear element of pixel P2 during the selection period Ts of the white-display period is greater than a voltage VmsB applied to the non-linear element of pixel P1 of the black-display period. Thus, the non-linear element of pixel P2 has a greater I-V characteristic shift. Note that, since the voltages applied to the non-linear elements of both of the pixels during the non-selection period is smaller than that during the selection period, the I-V characteristic shift due to the voltages applied to the non-linear element during the non-selection period can be ignored. Therefore, when the display changes to an intermediate display, I-V characteristic of the non-linear element of pixel P2 shifts so that the non-linear element of pixel P2 develops a greater resistance when a large voltage is applied than that of pixel P1. The effective voltage applied to the liquid crystal layer during the selection period is proportional to the shaded area in FIG. 10. In the above case, it is clear that S1>S2 and, as a result, pixel P2 ends up darker than pixel P1 and can be seen as an afterimage.

In this case, if a voltage applied to a non-linear element while it is displaying black is VmB and a voltage applied to a non-linear element while it is displaying white is VmW, a comparison of the effective voltages applied to each of the non-linear elements in the above display gives:

$$(1/T)\int VmWdt > (1/T)\int VmBdt \quad (1)$$

(white display) (black display)

where T=Ts+Th. In view of the voltage applied during the non-selection period Th which has substantially no effect on the I-V characteristic shift, the above Formula 1 can be rewritten as follows:

$$(1/Ts)\int VmWdt > (1/Ts)\int VmBdt \quad (2)$$

(white display) (black display)

Differences in the voltages applied to the non-linear elements during the selection period Ts generate a difference in magnitude of the I-V characteristic shift in the non-linear elements, and this leads to a difference in brightness between these two pixels that ought to exhibit the same brightness.

The afterimage described above is also generated in the case that the drive circuitry shown in FIG. 11 is used. Points at which the drive circuit of FIG. 11 differs from that of FIG. 1 are described below.

In the X driver 101, reference number 120 denotes an A/D converter for digitizing video signals which receives a video signal and generates n-bit digital data. Reference number 121 denotes a shift register that performs a shift in synchronization with the shift clock signal XSCL to sample the input digital signal. Reference number 122 denotes a latch circuit that latches and holds data that has been sampled by the shift register 121. Reference number 123 denotes an Xm drive circuit which drives the column electrode Xm by outputting a potential of either Va or −Va based on the AC inversion signal FRX for the column and the data held in the latch circuit 122.

In the Y driver 102, reference number 125 denotes a liquid crystal power generation circuit which inputs the Vp and −Vp voltages and generates the selection voltage signal Vs multiplexed in synchronization with the AC inversion signal FRY for the rows. This liquid crystal power generation circuit 125 is functionally the same as the inverter 110 of FIG. 1. The shift register 111 generates the selection signal Cn in the same way as in the configuration of FIG. 1. Reference number 112 denotes, in the same way as in FIG. 1, a power source selection switch for one cell of the drive circuitry for the row electrode Yn which drives the row electrode Yn by outputting one of Vs, Va, or −Va, based on the selection signal Cn. In this prior art example, the switching of Cn and FRY is done simultaneously, so that, when the selection signal Cn=1, an output potential of Yn=+Vp is selected when the row AC inversion signal FRY=1, and Yn=−Vp when FRY=0. However, the timing at which the selection signal Cn and the row AC inversion signal FRY switch over need not be simultaneous.

The operation of the prior art liquid crystal display device of FIG. 11 will now be described with reference to the timing chart of FIG. 12.

FIG. 12 is a timing chart of the column electrode signal Xm and the row electrode signal Yn, together with a difference signal Xm−Yn thereof. When FR (the polarity inversion signal)=0, Xm goes to −Va for an OFF level (Voff) and Va for an ON level (Von); when FR=1, Xm goes to Va for the OFF level (Voff) and −Va for the ON level (Von). The ratio of Von to Voff varies with the level of the video signal, to enable a display that includes intermediate displays obtained by pulse width modulation (PWM). The row electrode signal Yn outputs the selection voltage signal Vs during a selection period Ts, and a non-selection voltage Va or −Va during a non-selection period Th. The non-selection potential after a selection at positive potential Vp is Va, and that after a selection at negative potential −Vp is −Va.

The difference signal Xm−Yn is shown as a solid line in the signal chart at the bottom of FIG. 12. In this case, the broken-line track is that of the potential at the connection between the liquid crystal layer 113 and the non-linear element 114. Since a large voltage is applied to the non-linear element 114 during the selection period Ts, the current flowing therein is large, as can be seen from the I-V characteristic of FIG. 3, and the liquid crystal layer 113 is charged thereby. The amount of this charge is controlled by the amplitude of Xm−Yn during the selection period Ts, i.e., by the width of Von in the column electrode signal Xm. As described above, by changing the non-selection period's potential to match the polarity of the preceding selection period's potential, the signal level of the difference signal Xm−Yn is made positive in the non-selection period after a positive-polarity selection period, and negative in the non-selection period after a negative-polarity selection period. Therefore, the voltage applied to the non-linear element 114 in each non-selection period becomes small and thus it becomes difficult for the charge on the liquid crystal layer 113 to leak through the non-linear element 114 during the selection period.

The effect on the display of the I-V characteristic shift of FIG. 7 in the drive circuits of FIG. 11 will now be described. In FIG. 13, Xm1−Yn denotes the signal applied to pixel P1 of FIG. 8 and FIG. 9 and Xm2−Yn denotes the signal applied to pixel P2 thereof. A voltage VmsW applied to the non-linear element of pixel P2 during the selection period Ts of the white-display period is greater than a voltage VmsB applied to the non-linear element of pixel P1 of the black-display period, in the same manner as in FIG. 10. Thus, the non-linear element of pixel P2 has a greater I-V characteristic shift. Therefore, when the display changes to an intermediate display, I-V characteristic of the non-linear element of pixel P2 shifts to develop a greater resistance when a large voltage is applied than that of pixel P1. The effective voltage applied to the liquid crystal layer during the selection period is proportional to the shaded area in FIG. 13. It is clear that S1>S2 and, as a result, pixel P2 ends up darker than pixel P1 and can be seen as an afterimage.

In both of the circuits shown in FIG. 1 and FIG. 11, if a voltage applied to a non-linear element while it is displaying black is VmB and a voltage applied to a non-linear element while it is displaying white is VmW, a comparison of the effective voltages applied to the each of the non-linear elements in the above display gives the same result as that of Formula 1. Since it is considered that the voltage applied during the non-selection period Th has substantially no effect, Formula 1 can be rewritten as the above Formula 2. Therefore, the circuitry of FIG. 11 suffers from the same problem in that differences in the voltage applied to the non-linear elements during the selection period Ts generate a difference in magnitude of the I-V characteristic shift in the non-linear elements, and this leads to a difference in brightness between non-linear elements that ought to exhibit the same brightness.

SUMMARY OF THE INVENTION

An objective of the present invention is to solve aforementioned technical problem, i.e., the problem of afterimages in the active-matrix liquid crystal display device utilizing the two-terminal element as the switching element of the pixel.

In order to solve the above-described problem, the method of driving a liquid crystal display device that comprises a plurality of row electrodes to which a scanning signal is applied, a plurality of column electrodes to which a data signal is applied, and a plurality of pixels formed at a plurality of intersections between the row and column electrodes, each of the pixels comprising a liquid crystal layer and a two-terminal element having non-linear resistance characteristics connected in series therewith, the method of driving a liquid crystal display device comprising steps of: applying the voltage of a difference signal between the scanning signal and the data signal to each of the pixels; applying a write voltage to each of the pixels based on the difference signal during a data write period TB in which each of the row electrodes is selected and the liquid crystal layer of each of the pixels is charged with a data charge voltage corresponding to the data signal; applying a hold voltage of an absolute value smaller than the write voltage to each of the pixels based on the difference signal during a data hold period after the data write period TB; and applying a compensatory voltage to each of the pixels during a compensatory period TA before the data write period TB, whereby a compensatory charge voltage of a polarity opposite to that of the data charge voltage is charged into the liquid crystal layer of the pixel, the compensatory charge voltage being set into a relationship with the data charge voltage such that the compensatory charge voltage is small if the data charge voltage is large, but large if the data charge voltage is small.

To define the present invention from another aspect, a method of driving a liquid crystal display device which comprises a plurality of column lines and row lines and a plurality of pixels, each pixel including a display element and a non-linear resistance element connected in series between said column and row lines, said method of driving the liquid crystal display device comprising the step of: applying a first higher voltage between said column and row lines so that a display data is supplied to said display element of the pixel, in a selection period of the pixel; applying a lower voltage than said first higher voltage between said first and second lines, in a non-selection period of the pixel after said selection period; applying a second higher voltage than said lower voltage between said first and second lines, in a compensatory period of the pixel before said selection period and after said non-selection period, wherein said second higher voltage in said compensatory period has a polality oposite to that of said first higher voltage in said selection period, a root-mean-square (RMS) of said second higher voltage in said compensatory period and a RMS of said first higher voltage in said selection period is in a relation that: the RMS of said second higher voltage is large when the RMS of said first higher voltage is small, and is small when the RMS of said first higher voltage is large.

In this case, the relationship between the compensatory charge voltage and the compensatory charge voltage is and the compensatory charge voltage preferably in a complementary relationship with the data charge voltage in view of a display gradation.

In accordance with the present invention, a compensatory voltage is applied to each pixel immediately before the data write period so that the liquid crystal layer of the pixel is charged with a compensatory charge voltage of a polarity opposite to that of the data charge voltage in the data write period. Thus, a large voltage is applied to the non-linear element immediately before the data write period and, moreover, this compensatory voltage is preferably set to have a complementary relationship in view of the display gradation with the voltage to be charged into the liquid crystal layer of the pixel during the write. This means that the I-V characteristic shift of the non-linear element can be kept substantially uniform, irrespective of what the pixel is displaying, and that the occurrence of afterimages caused by the magnitude of the I-V characteristic shift can thus be controlled.

The method of the present invention is suitable for driving a liquid crystal display devices such as a TV, a display of personal computer, a projector, a head mounted display or a printer having a liquid crystal shutter etc.

When the method of the present invention is carried out, the root-mean-square values of the voltages applied to the two-terminal element could be set so that they are substantially equal for each two-terminal element of the pixels. If the period of time during which the compensatory voltage is applied is a compensatory period TA and the period of time during which the data is written is a data write period TB, the temporal ratio of the period TA to the period TB can be used to adjust the root-mean-square values of the voltages to be applied to the two-terminal element. Alternatively, the absolute values of the potentials of the scanning signal during the periods TA and TB can be made different, and these scanning signal potentials can be used to adjust the root-mean-square values of the voltages to be applied to the two-terminal element In a further alternative, the potentials of the data signal during the periods TA and TB can be made different, and these data signal potentials can be used to adjust the root-mean-square values of the voltages applied to the two-terminal element.

Noise can be counteracted by either making TA/(TA+TB) $\leqq$¼, where (TA+TB) equals one horizontal scanning period, or by making sure that the period TA is in a flyback period of the video signal along the time axis. In other words, any noise that may be caused by the large voltage change at the boundary between the compensatory voltage and the write voltage of different polarities can be superimposed in the flyback period of the video signal, so that it does not appear as noise on the liquid crystal panel.

When the present invention is carried out, the data signal is set to a voltage corresponding to a display gradation in each horizontal scanning period and is also at the same voltage level within one horizontal scanning period; and the scanning signal is set to be such that the period TA and the data write period TB have different polarities with respect to a middle potential of the data signal in the voltages each of which is charged into the liquid crystal layer.

When the difference is obtained between the data signal which remains at the same voltage level within one horizontal scanning period and the scanning signal which gives different polarities to the voltages to be charged into the liquid crystal layer in the periods TA and TB, the voltage applied to the pixel in the period TA and that applied in the period TB are in a complementary relationship in view of the display gradation regarding the voltage that is charged into the liquid crystal layer of the pixel. Therefore, by simply improving the waveform of the scanning signal, it becomes possible to control the afterimage phenomenon based on the principle of the method according to the present invention.

In this case too, by setting the time ratio between the periods TA and TB, or by setting the potentials of the scanning signal in the periods TA and TB, it is possible to adjust the root-mean-square values of the voltages to be applied to the two-terminal element to be substantially equal for each of the two-terminal elements of the pixels. Therefore, the I-V characteristic shift of the non-linear element can be made always uniform, irrespective of the type of display, and thus afterimages can be eliminated.

When the absolute values of the potential of the scanning signal in the periods TA and TB with respect to a middle potential of the data signal are made equal, the relationship could be such that TA>TB. Alternatively, if the times of the periods TA and TB are substantially equal, and the voltage of the scanning signal with respect to a middle potential of the data signal in the period TA is VTA and that in the period TB is VTB, these voltages could be set such that |VTA|>|VTB|. In either case, the root-mean-square values of the voltages to be applied to the two-terminal element can be made to approach a situation in which they are substantially equal with respect to the two-terminal element of each pixel.

If the voltage of the data signal is not made uniform in one horizontal scanning period, but is set to a voltage corresponding to a display gradation in the period TB, and to a voltage of an absolute value greater than that in the period TB in the period TA, the root-mean-square values of the voltages to be applied to the two-terminal element can be made to approach a situation in which they are substantially equal for each two-terminal element of the pixels. In this way, the absolute value of the scanning signal with respect to a middle potential of the data signal can be made substantially equal in the periods TA and TB.

The method of the present invention can also be applied to a case in which the data signal has a potential Von that is supplied a voltage of a large absolute value onto each pixel or a potential Voff that is supplied a voltage of a small absolute value thereto based on the polarity of the scanning signal in the data write period TB with respect to a middle potential of the data signal, and works as a pulse-width modulation signal that varies the pulse width of the potential Von in the period TB to correspond with the voltage that is charged into the liquid crystal layer of each pixel. In this case, the data signal has two potentials, Von or Voff in the period TB, and duty of the pulse widths of the potential Von to the period TA is substantially equal to duty of the pulse width of potential Von to the period TB.

In this way, the data signal is set to be such that the duties of the pulse widths of the potential Von to the periods TA and TB are substantially equal and the scanning signal is set to be such that the periods TA and TB have different polarities on the voltages each of which is charged into the liquid crystal layer of the pixel, so that the values of the difference signal between the data signal and the scanning signal in the periods TA and TB are in a complementary relationship in view of the display gradation, and thus afterimages can be controlled on the basis of the principle of the present invention.

In this case, a difference signal between the data signal and the scanning signal comprised a period ToffA which corresponds to the pulse width of the potential Von of the data signal in the period TA, a period TonA which is is the rest of that period TA (i.e., TA=TonA+ToffA), a period TonB which corresponds to the pulse width of the potential Von of the data signal in the period TB, and a period ToffB which is the rest of that period TB (i.e., TB=TonB+ToffB), and the ratios TonA/TA and TonB/TB are substantially in a complementary relationship.

By setting TonA, ToffA, TonB, and ToffB periods in each of the periods TA and TB of the difference signal to be applied to the pixel, as described above, the difference signals in the periods TA and TB can be made to be in a complementary relationship in view of the display gradation, so afterimages can be controlled on the basis of the principle of the present invention.

When the data signal is used as a pulse width modulation signal as described above, the initial part of the period TB should be the period ToffB and the ending part thereof should be the period TonB. However, the period TA can be set so that the period TonA is either the initial part of the period TA or the ending part thereof. Setting the period TonA to the initial part of the period TA is considered superior, from the point of view that it is comparatively easy to generate the data signal in that case.

When the data signal is used as a pulse width modulation signal as described above, the root-mean-square values of the voltages to be applied to the two-terminal element can be adjusted so that they are substantially uniform for each of the two-terminal elements of the pixels by setting the time ratio of the period TA to the period TB or by making the potentials of the scanning signal different in the periods TA and TB.

If the data signal has a potential VonB that supplies a voltage of a large absolute value to each pixel or a potential VoffB that supplies a voltage of a small absolute value thereto based on the scanning signal, and if the data signal works as pulse-width modulation signal that varies the pulse width of the potential VonB in the period TB to correspond with the voltage that is charged into the liquid crystal layer of each pixel, the data signal can also have potential VonA or VoffA in the period TA of absolute values greater than those of the corresponding potentials VonB or VoffB, respectively, and the duty of the pulse widths of the potential VonA to the period TA is substantially equal to duty of the pulse width of potential VonB to the period TB.

The method of the present invention can be used with a two-terminal element that has a metal-insulator-metal layer structure (an MIM element), a metal-insulator-semiconductor layer structure (an MIS element), one type of MIM element comprises, the insulator layer which is preferably an oxide film formed by anodic oxidization in an electrolytic liquid including phosphorus in a form such as phosphoric acid or ammonium phosphate. Other type of MIM element comprises the insulator layer which is a silicon nitride.

It has been confirmed experimentally that the above-described configurations can greatly reduce the I-V characteristic shift in comparison with the driving method shown by FIG. 6.

The insulator layer is also preferably formed by anodic oxidization of tantalum. If an MIM element is used as the non-linear element, one of the metal layers thereof can be made a transparent conductive layer, so that it can also function as a transparent electrode of the liquid crystal panel.

BRIEF DESCRIPTION OF THE DRAWINGS

FIG. 29 is divided into FIG. 29A to FIG. 29D, each used to illustrate the drive circuits for generating the column electrode signal Xm, or the operation thereof.

DETAILED DESCRIPTION OF THE PREFERRED EMBODIMENTS

First Embodiment

Figure 1:
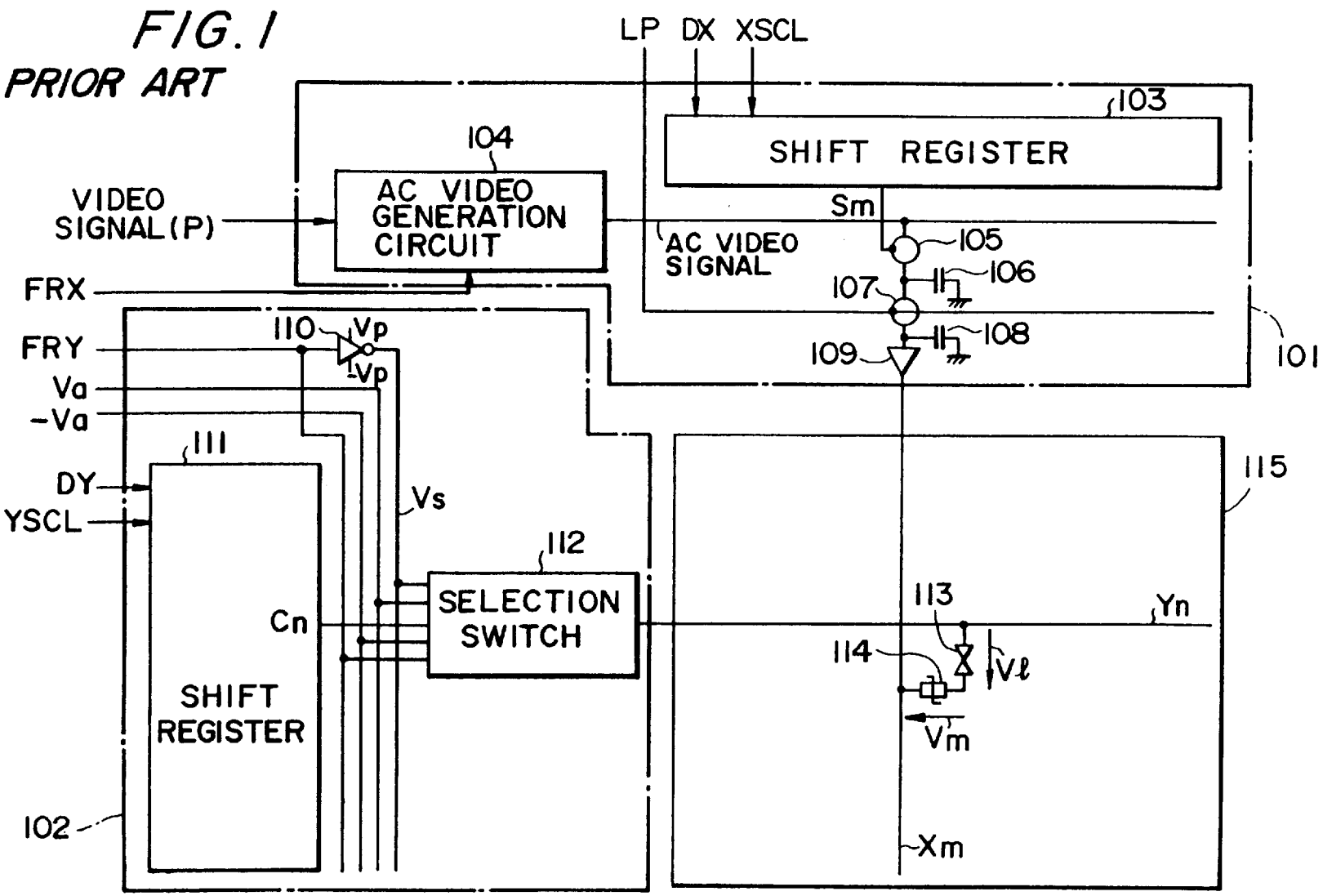
FIG. 1 PRIOR ART
FIG. 1 is a structural diagram of a liquid crystal display device.
Figure 2:
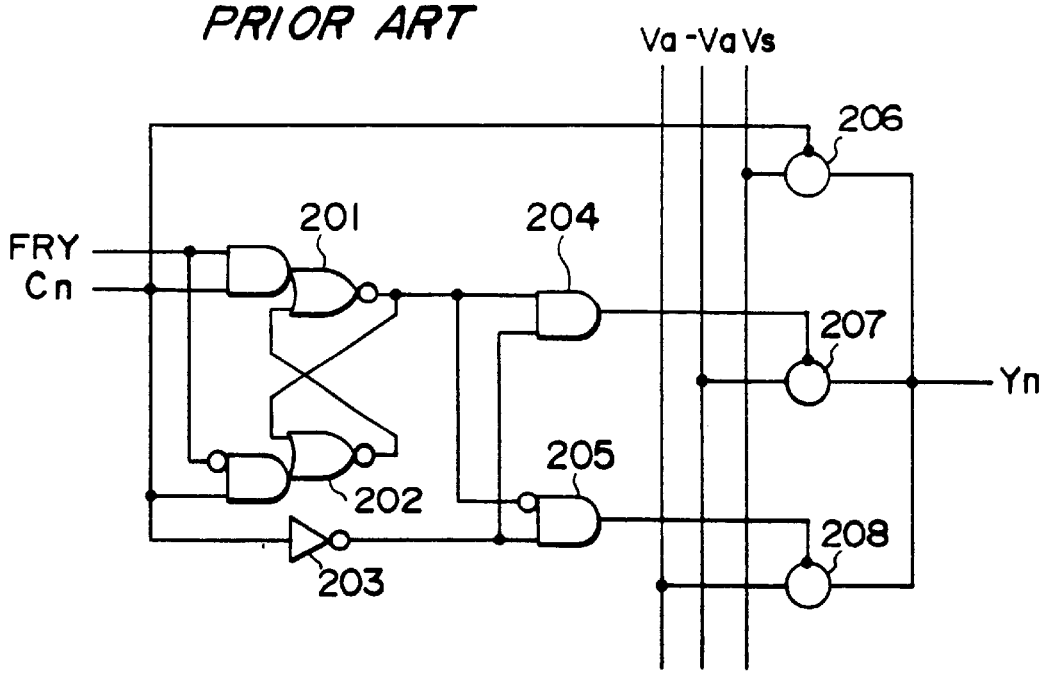
FIG. 2 PRIOR ART
FIG. 2 is a structural diagram of a voltage selection switch within the row drive circuit of the device of FIG. 1.
Figure 3:
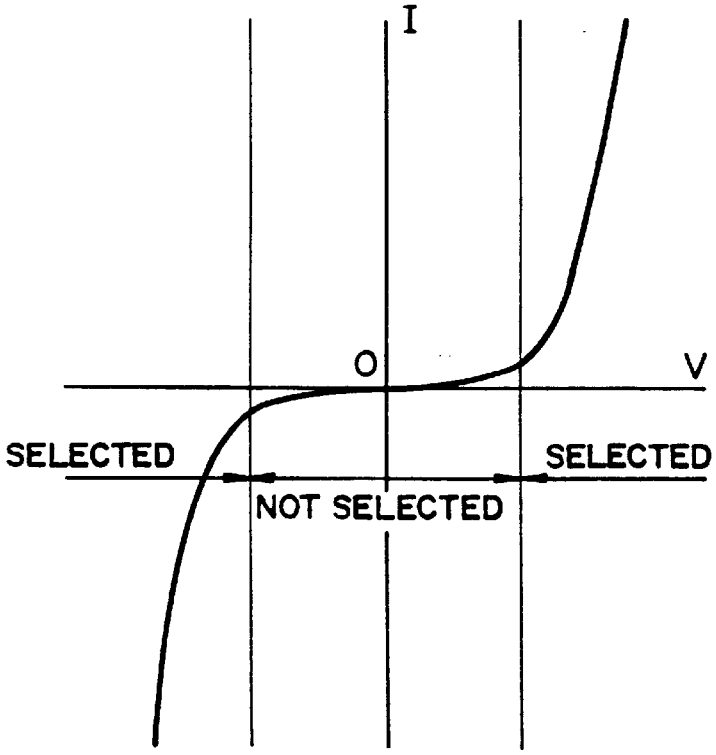
FIG. 3 PRIOR ART
FIG. 3 shows the I-V characteristic of a non-linear element.
Figure 4:
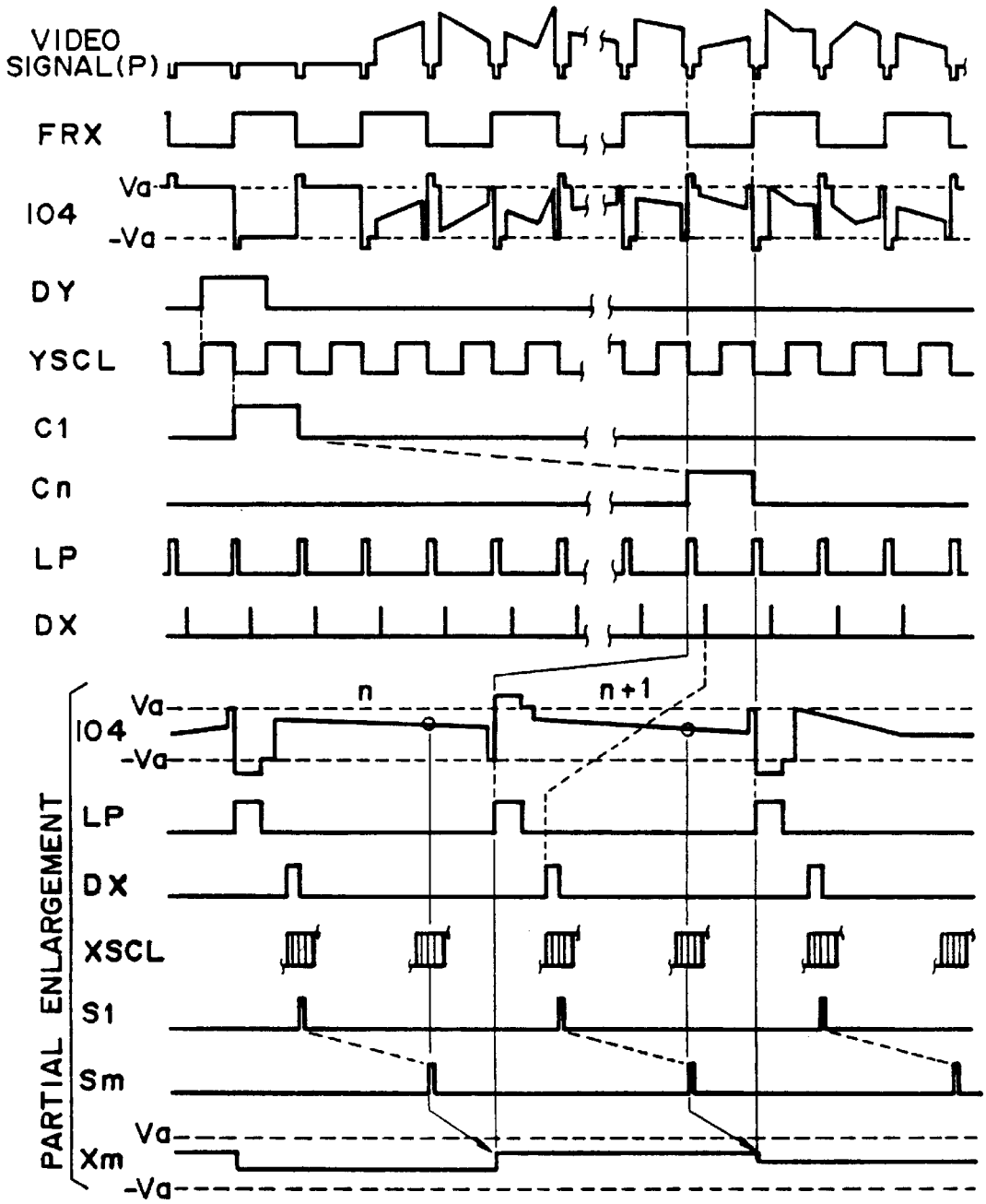
FIG. 4 PRIOR ART
FIG. 4 is a timing chart in accordance with the prior art example of components shown in FIG. 1.
Figure 11:
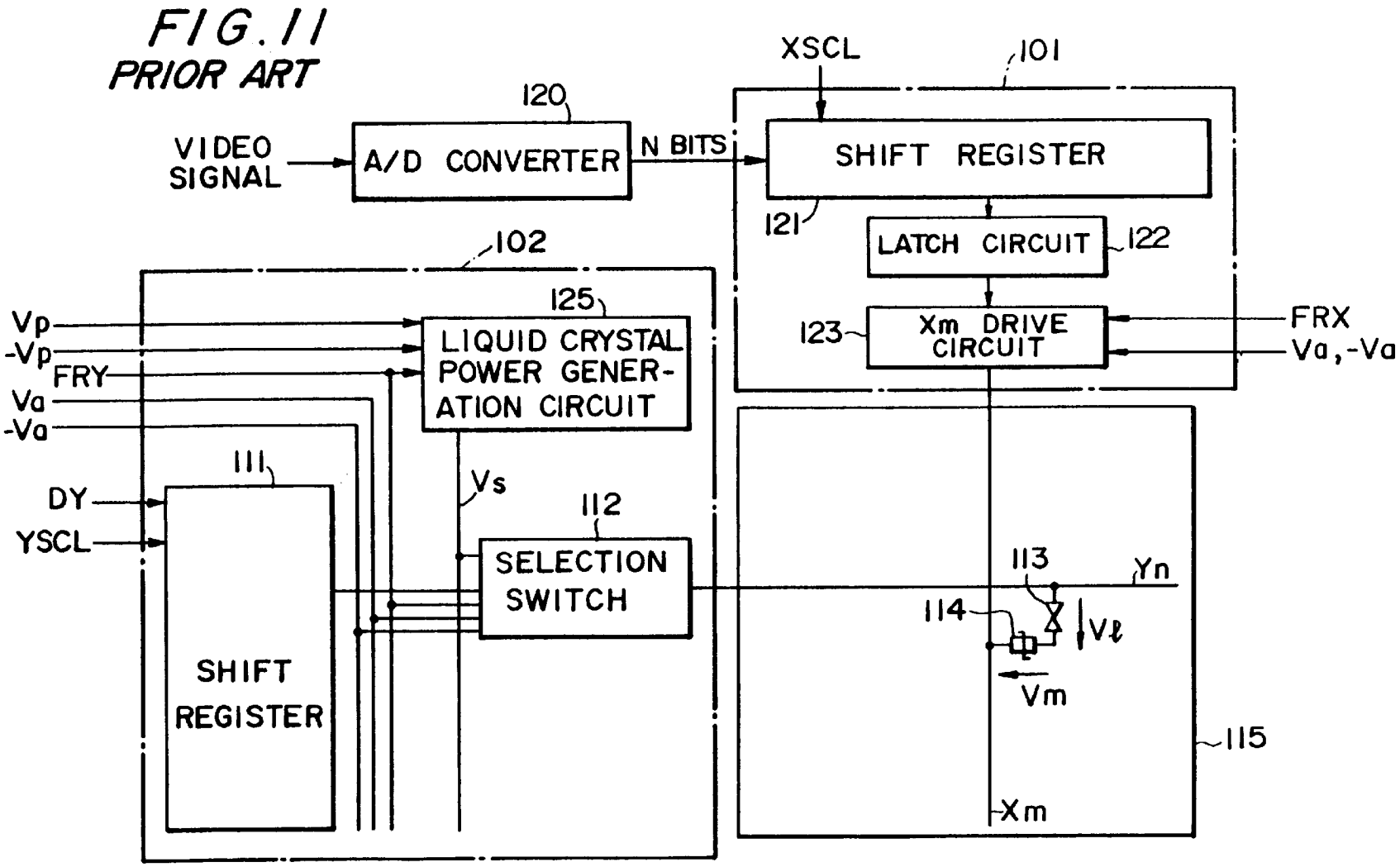
FIG. 11 PRIOR ART
FIG. 11 is a structural diagram of another example of a liquid crystal display device.

A first embodiment of the present invention is an improvement to the drive method used by the liquid crystal display device of FIG. 1, and its internal configuration and functions are those of the device of FIG. 1 that has already been described. Note that the non-linear elements 114 of FIG. 1 and FIG. 11 that are used in the method of driving a liquid crystal display device in accordance with the present invention, as described as embodiments 1 to 6 herein, could be MIM elements, MIS elements, varistors, ring diodes, or back-to-back diodes. Note also that an MIM element could be configured with one metal layer thereof being a transparent conductive layer which can be made to serve also as a transparent electrode of the liquid-crystal panel. Further, the insulator layer of the MIM element could be a silicon nitride. In these embodiments, scanning signals are supplied to row electrodes, and data signals are supplied to column electrodes as shown in FIG. 11. Alternatively, it is also possible to supply scanning signals to column electrodes, and to supply data signals to row electrodes.

Figure 14:
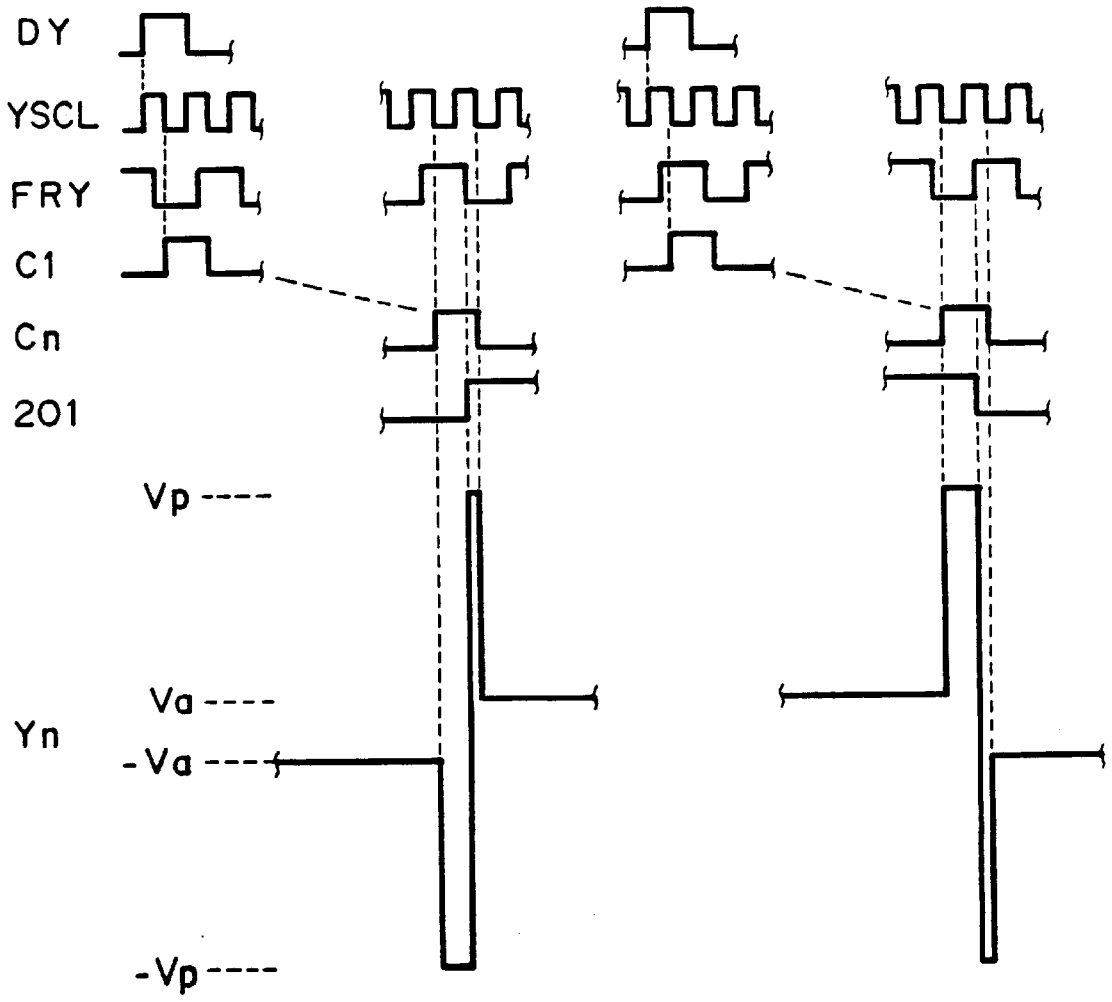
FIG. 14 is a timing chart of driving in the row direction, in accordance with a first embodiment of the present invention.
Figure 15:
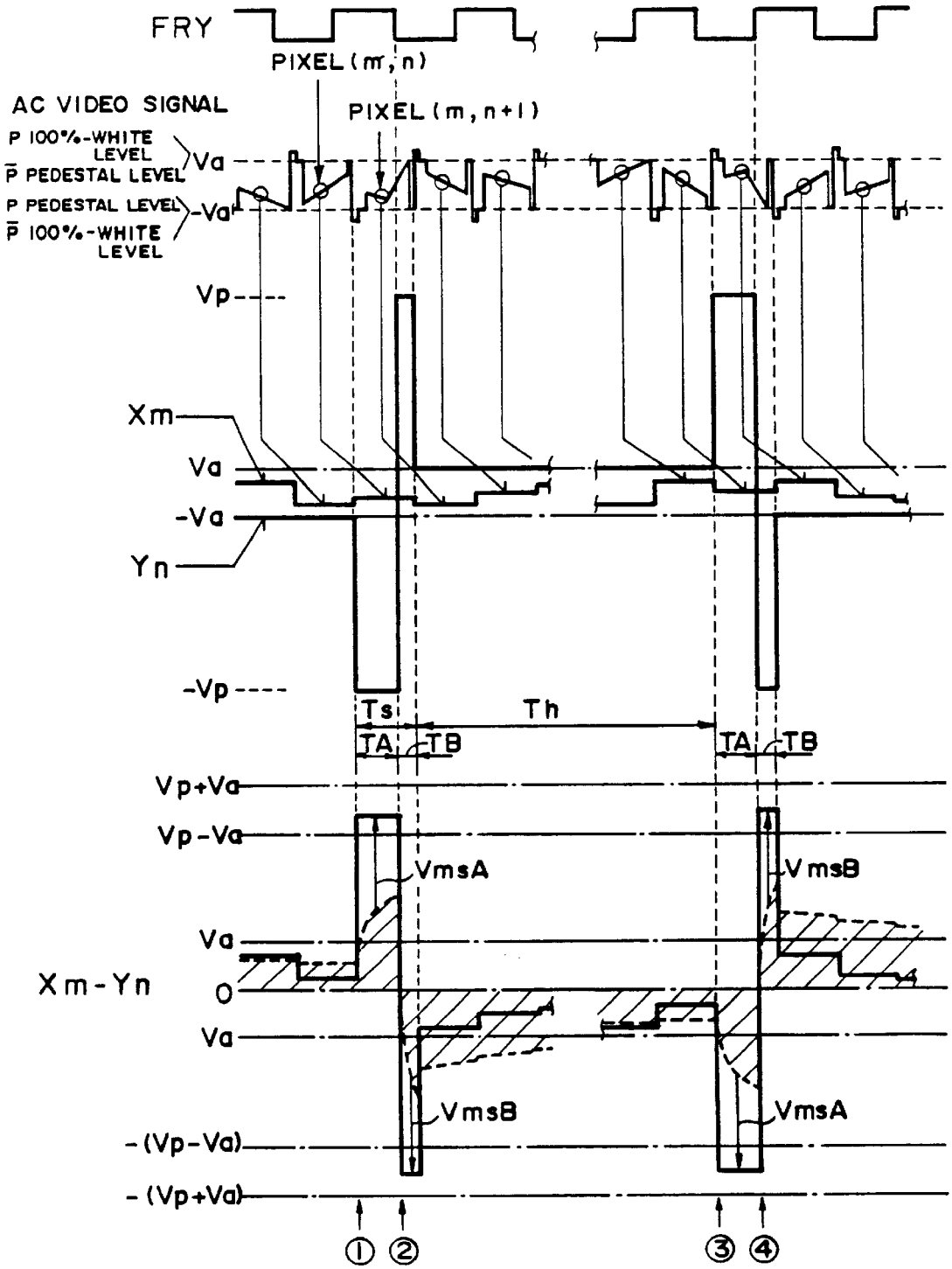
FIG. 15 is a drive waveform diagram of the liquid crystal panel in accordance with the first embodiment of the present invention.

The timing chart of the first embodiment is illustrated in FIG. 14 and FIG. 15. FIG. 14 is a timing chart of the Y driver which is necessary for carrying out the first embodiment of the present invention. Note that the DY, YSCL, FRY, C1, and Cn signals are the same as those that have already been described with reference to FIG. 5. Y driver outputs the selection voltage signal Vs as the output Vn when the selection signal Cn is 1 in the same way, but in order to carry out this first embodiment, the phase relationship between the selection signal Cn and the AC inversion signal FRY is changed. In the prior art drive (see FIG. 5), the timing at which Cn and FRY switch is the same, but in this first embodiment their phase relationship is shifted so that the phase of FRY is changed in the time period when Cn=1. FIG. 14 illustrates this change in detail. The left-hand side of FIG. 14 shows that when Cn is 1 and the selection voltage signal Vs is being output as the output Vn, FRY switches from 1 to 0. Since the potential of the selection voltage signal Vs switches by switching of FRY (when FRY=1, Vs=Vp; when FRY=0, Vs=−Vp), the potential −Vp changes into Vp after switching of FRY. Similarly, the right-hand side of FIG. 14 shows the opposite case for Yn when Cn=1, where FRY switches from 0 to 1. In this case, the potential Vp changes into −Vp after the switch in FRY. In this embodiment, the switch in FRY is set to occur in the ending part of the period during which Cn=1, so the duty ratio is increased in this ending part, but this change in the phase relationship between Cn and FRY enables this duty ratio to be freely selected.

Figure 6:
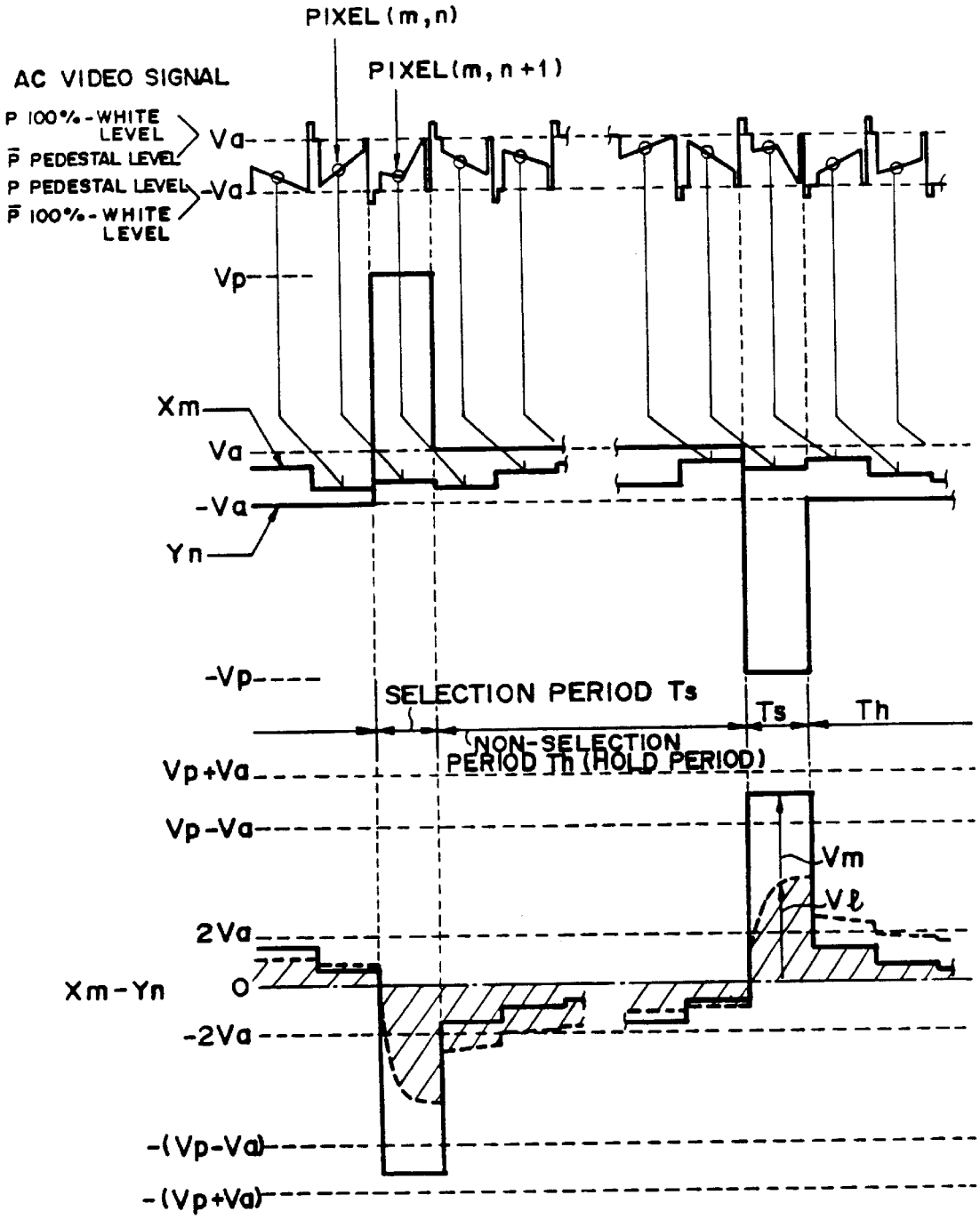
FIG. 6 PRIOR ART
FIG. 6 is a drive waveform chart in accordance with the prior art example of the liquid crystal panel.
Figure 7:
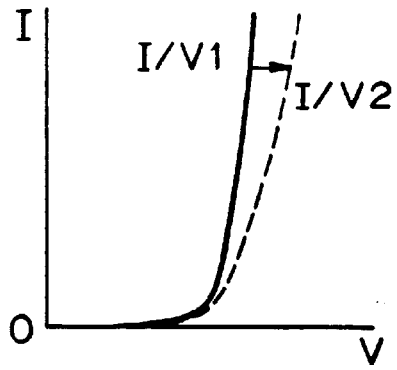
FIG. 7 PRIOR ART
FIG. 7 is a diagram illustrating the I-V characteristic shift of a non-linear element.

The actual drive created by combining the operation of the above-described Y driver and the X driver will now be described with reference to FIG. 15. This figure shows the waveforms of signals applied to the pixel that is the mth pixel in the horizontal direction and the nth pixel in the vertical direction, in the liquid crystal panel 115 of FIG. 1, in the same manner as already described for FIG. 6. The column electrode signal Xm sequentially samples the AC video signal 104, holds the data for one horizontal scanning period, then outputs the data, in the same way as in the prior art, so that the output data itself represents the data for the previous horizontal scanning period. The row electrode signal Yn is the same as the signal in FIG. 11, which was described above. In this case, one horizontal scanning period is the period obtained by multiplying one field period by the number of data lines (the number of column electrodes). If a rest period is set for a certain column electrode, only column electrodes that do not have a rest period set for them are included in the calculation.

Now look at the difference signal Xm−Yn between the column electrode signal Xm and the row electrode signal Yn, both of which are actually applied to the non-linear element 114 and liquid crystal layer 113. The column electrode signal Xm outputs the same level within one horizontal scanning period, but the polarity of the row electrode signal Yn inverts greatly during one horizontal scanning period. Therefore, the polarity of the difference signal also changes greatly between positive and negative, as shown at the bottom of FIG. 15. On the left-hand side of FIG. 15, large potential of positive polarity is applied to the pixel, then the potential swings over greatly to the negative polarity side. On the right-hand side of FIG. 15, after application of large negative potential to the pixel, the potential changes greatly to positive polarity. It can be seen from FIG. 15 that the pixel is selected twice, i.e., in two selection periods, TA and TB, within one horizontal scanning period. When the non-linear element 114 is selected twice, the second selection determines the gradation value. Therefore, as shown in FIG. 15, it is the selection of the ending period TB that determines the display gradation (in the example on the right-hand side of the figure, this is a write at positive polarity side). This means that, with the drive of FIG. 15, a display gradation (or rather, the root-mean-square value actually applied to the liquid crystal layer 113) has the same effect as that of FIG. 6.

A point that should be noted is the potential of the difference signal Xm−Yn in each of the initial period TA and the ending period TB of one horizontal scanning period. As described above, the display gradation is determined by the ending selection. Regarding the initial selection, the selection data for the initial period TA is the complement of the data of the ending period TB in this first embodiment. Note that in this case, "complement" is defined here as either of two numbers which together achieve a level of 100%. For example, 0 is the complement of 1, and 0.9 is the complement of 0.1. The state of the column electrode signal described below shows the reason for this complementary relationship.

In the following description, the pixels show a white display when a voltage equal to or more than the threshold voltage is applied to the liquid crystal layer and show a black display when a voltage less than the threshold voltage is applied to the liquid crystal layer. This mode of display is defined here as a negative display. In the case of applying a voltage of positive polarity to the liquid crystal layer, the potential of the column electrode signal is Va when the pixels show a white display and −Va when the pixels show a black display. Conversely, in the case of applying a voltage of negaive polarity to the liquid crystal layer, the potential of the column electrode signal is −Va when the pixels show a white display and Va when the pixels show a black display. When the data to be displayed is white and a voltage to be applied is positive polarity, the potential of the column electrode signal is Va. When the data to be displayed is black and a voltage to be applied is negative polarity, the potential of the column electrode signal is also Va. In other words, the complement relationship defined above for the column electrode signal is valid when viewed from the viewpoint of positive and negative polarity. It should be clear from FIG. 15 that an intermediate display would function in exactly the same manner. In such a case, with the drive of FIG. 15, to correspond with the selection that will determine the display gradation in the ending period TB (hereinafter referred to as the "actual selection"), data that is the complement thereof is written in the initial period TA (hereinafter referred to as the "compensatory selection"). This operation enables a reduction in afterimages caused by I-V characteristic shift in the non-linear elements.

Figure 16:
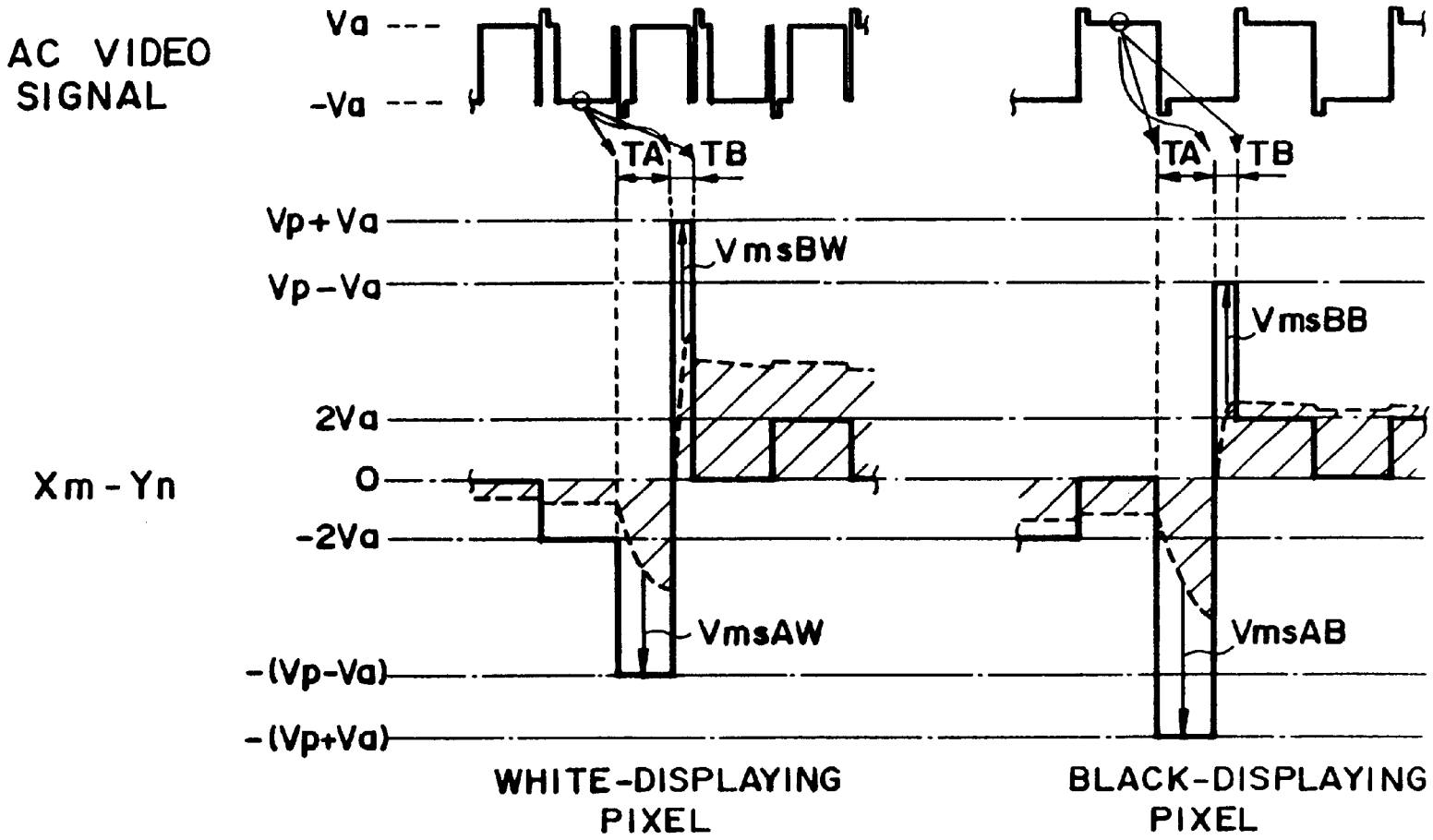
FIG. 16 illustrates the principle of afterimage reduction in accordance with the first embodiment of the present invention.

The principle by which the first embodiment can reduce the afterimages in the non-linear elements caused by I-V characteristic shift will now be described in detail with reference to FIG. 16. The description first concerns a white display, shown in the left-hand side of FIG. 16. In order to display white, the write potential for the actual selection in the ending period TB is at a maximum at |Vp+Va|. The compensatory selection in the initial period TA writes data that is the complement thereof, and so is at the minimum potential of |Vp−Va|. Conversely, when black is displayed (corresponding to the right-hand side of FIG. 16), the write potential for the actual selection in the ending period TB is at a minimum at |Vp−Va|, and the compensatory selection in the initial period TA is at a maximum of |Vp+Va|. When white is selected, a large potential is applied to the non-linear element during the actual selection, but only a small potential is applied to the non-linear element in the preceding compensatory selection. Conversely, when black is selected, the potential to be applied in the actual selection is small, but a large potential is applied to the non-linear element during the compensatory selection. This means that the total potential applied to the non-linear element can be made the same, regardless of whether black or white is selected.

To be precise, if the effective voltage VmW for white display and the effective voltage VmB for black display which are applied to the non-linear element are made the same, the I-V characteristic shift of the non-linear element can be made uniform, and the phenomenon of afterimages caused by I-V characteristic shift can be eliminated. Writing the conditions of FIG. 16 as an equation gives:

$$(1/TA)\int VmsAW+(1/TB)\int VmsBW=(1/TA)\int VmsAB+(1/TB)\int VmsBB \quad (3)$$

Therefore, it is best to ensure that the values in the initial period TA (the compensatory selection) and the ending period TB (the actual selection) satisfy the above equation. In general, in the beginning of the compensatory selection period, the potential applied to the non-linear element changes to the compensatory selection potential from that applied in the non-selection period. On the left-hand side of FIG. 16, this potential goes from −2Va to −(Vp−Va); on the right-hand side, it goes from 0 to −(Vp+Va). In the beginning of the actual selection, however, the potential applied to the non-linear element changes much more, from the compensatory selection potential to the actual selection potential. On the left-hand side of FIG. 16, this potential goes from −(Vp−Va) to (Vp+Va); on the right-hand side, it goes from −(Vp+Va) to (Vp−Va). Therefore, a larger potential is applied to the non-linear element for the actual selection, and consequently TA>TB.

Figure 10:
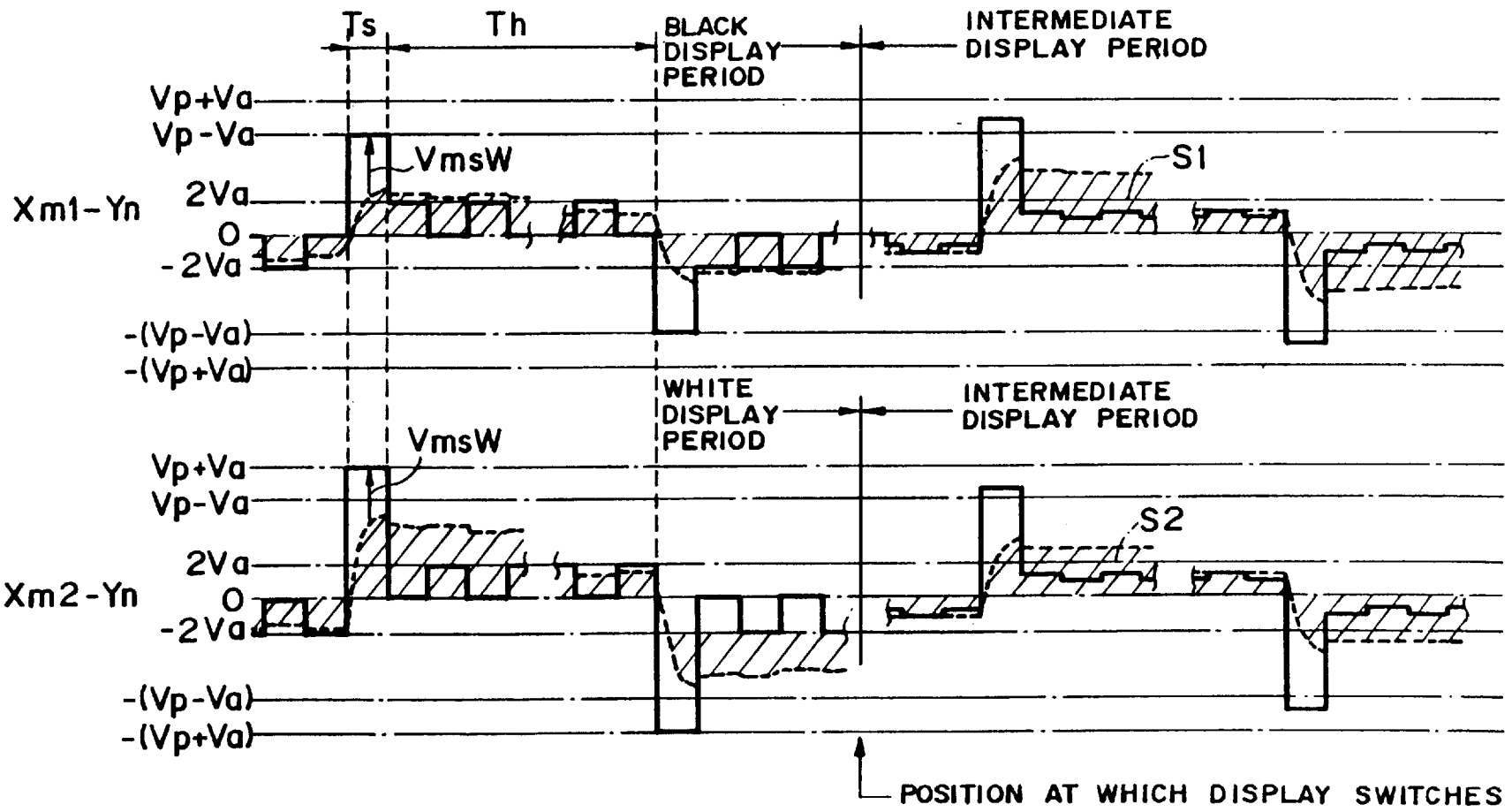
FIG. 10 PRIOR ART
FIG. 10 is a drive waveform chart in accordance with the prior art example, illustrating the generation of an afterimage due to the I-V characteristic shift of non-linear elements.
Figure 17:
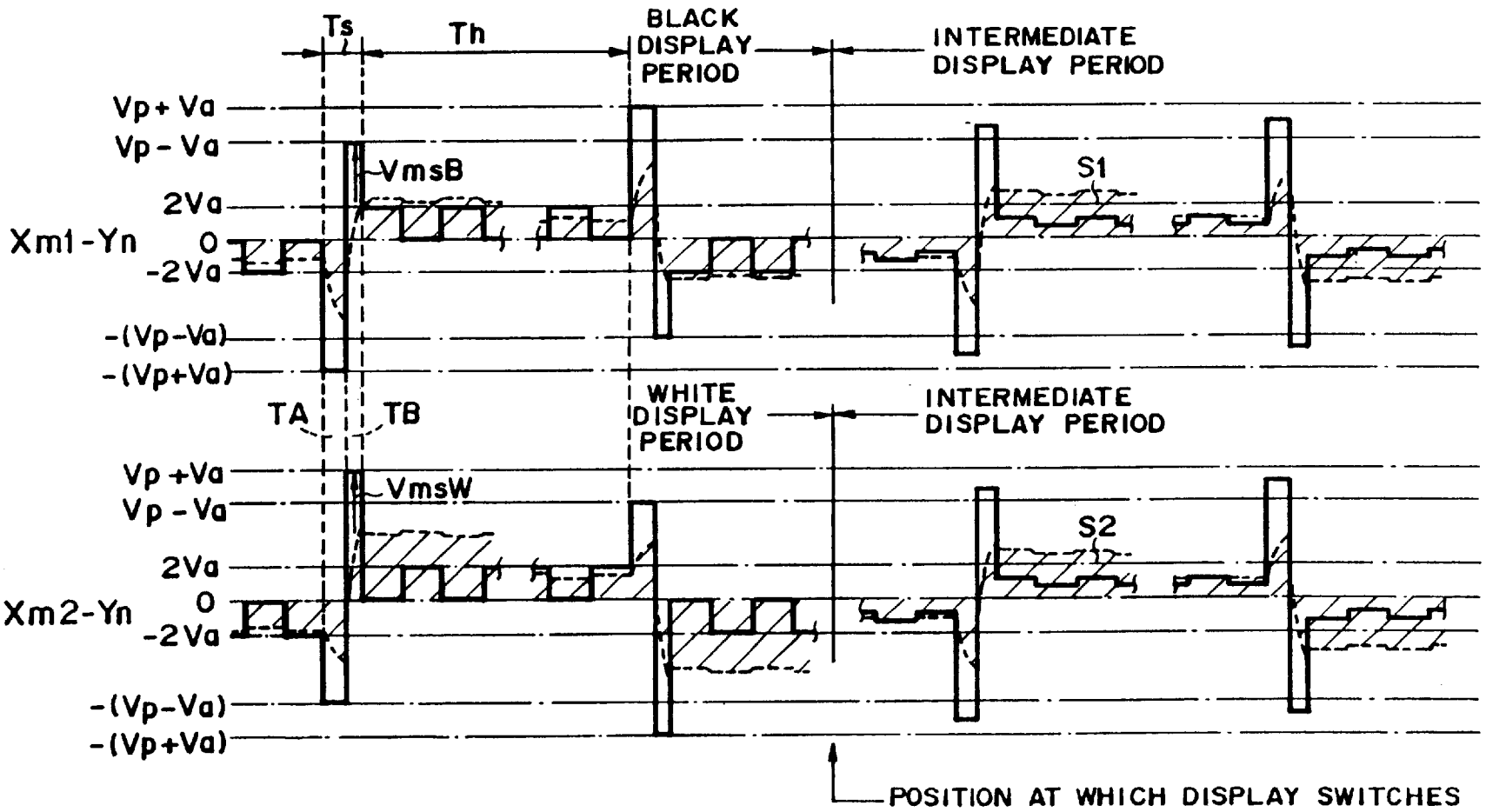
FIG. 17 is a drive waveform diagram used to reduce afterimages in accordance with the first embodiment of the present invention.

The enabling of a dramatic reduction in afterimages due to I-V characteristic shift of the non-linear element will now be described with reference to the example of FIG. 17. In the same way as described with reference to FIG. 10, the signal applied to pixel P1 (in other words, Xm1−Yn) and the signal applied to pixel P2 (in other words, Xm2−Yn) are shown in FIG. 17. Pixel P1 shows a black display and pixel P2 shows a white display. When the display is switched to an intermediate display at this point, the principle described above dictates that the effective voltage VmsB applied to pixel P1 and the effective voltage VmsW applied to pixel P2 are equal, so the magnitude of I-V characteristic shift in the non-linear elements thereof is similarly equal. Therefore, the effective voltage S1 applied to pixel P1 and the effective voltage S2 applied to pixel P2 during intermediate display are also equal, and thus the difference in brightness described with reference to FIG. 10 can be eliminated.

Note that, for the purpose of facilitating understanding of this embodiment of the present invention, only the cases of black and white display were described, but the present invention is also capable of equalizing the I-V characteristic shift of non-linear elements under all display conditions. This means that the phenomenon of afterimages can be reduced, irrespective of the type of display.

Second Embodiment

Figure 18:
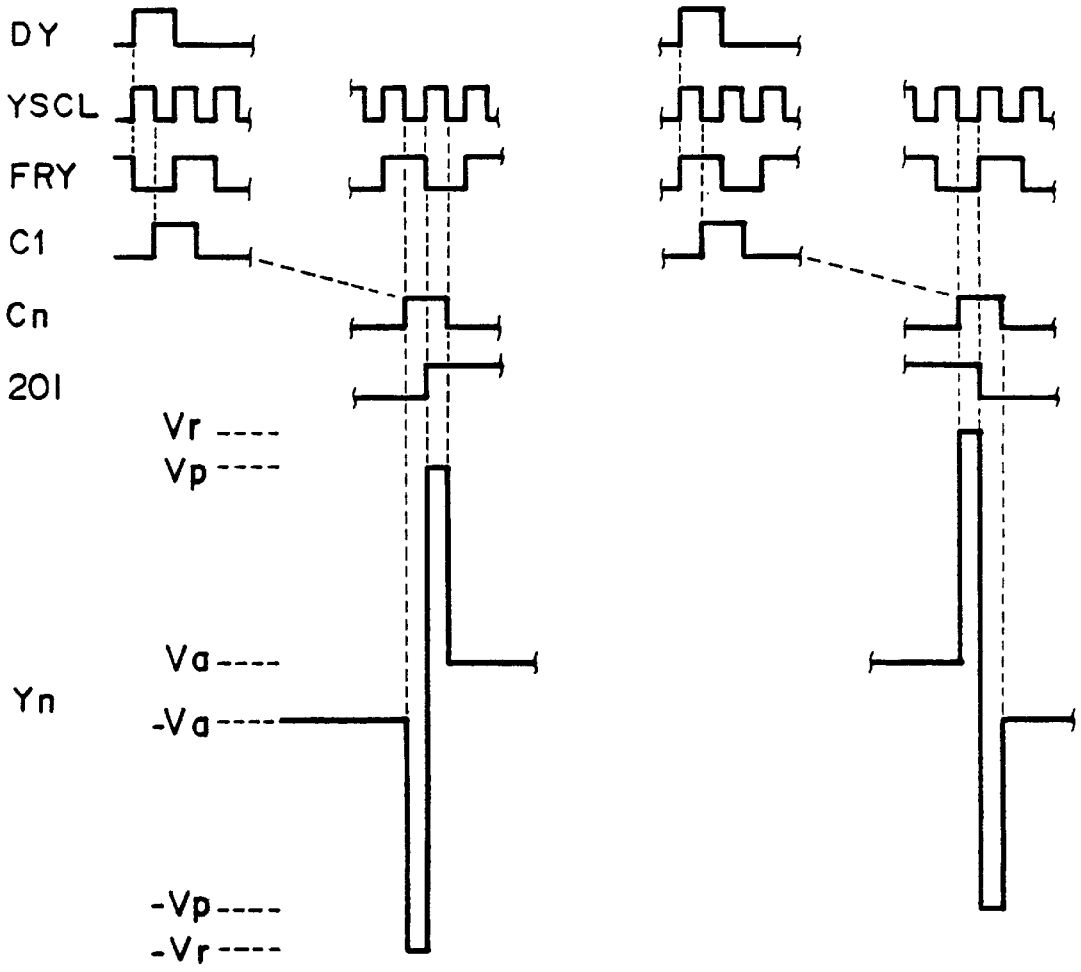
FIG. 18 is a timing chart of driving in the row direction, in accordance with a second embodiment of the present invention.

FIG. 18 is a timing chart of the Y driver which is necessary for carrying out a second embodiment of the present invention. Note that the DY, YSCL, FRY, C1, and Cn signals are the same as those that have already been described with reference to FIG. 5. The duty ratio of YSCL is 50% and it is used as a switching signal to switch the potential of the signal Vs from ±Vr to ±Vp. In other words, Vs is output in accordance with the following relationships:

When YSCL (switching signal)=0 with FRY=0: Vs=Vr
When YSCL (switching signal)=1 with FRY=0: Vs=Vp
When YSCL (switching signal)=0 with FRY=1: Vs=−Vr
When YSCL (switching signal)=1 with FRY=1: Vs=−Vp Y driver outputs the selection voltage signal Vs as the output Vn when the selection signal Cn is 1 but, in order to carry out this second embodiment, the phase relationship between the selection signal Cn and the AC inversion signal FRY is changed to make sure that |Vr|>|Vp|. In the prior art drive, the timing at which Cn and FRY switch is the same, but in this second embodiment, their phase relationship is shifted so that the phase of FRY is changed in the time period when Cn=1. FIG. 18 illustrates this change in detail. The left-hand side of FIG. 18 shows the selection voltage signal Vs output as Yn when Cn is 1. At this point, the above relationships dictate that Vs is −Vr and ouptputs relatively larger voltage than −Vp. Next, in the period in which Cn=1, FRY switches from 1 to 0. At the same timing, YSCL (the Vr and Vp switching signal) switches from 0 to 1, so that Vp is output as the selection voltage signal Vs for Yn. In other words, after the Yn output is −Vr, the switch in FRY changes it to Vp. The right-hand side of FIG. 18 shows the opposite case for Yn when Cn=1; where FRY switches from 0 to 1 and YSCL also switches from 0 to 1. In this case, Yn outputs −Vp by switching in FRY after Yn outputs Vr. In this embodiment, the switch in FRY is set to occur in the middle of the period when Cn=1, in such a manner that this period is divided evenly, but this duty ratio can be freely selected.

Figure 19:
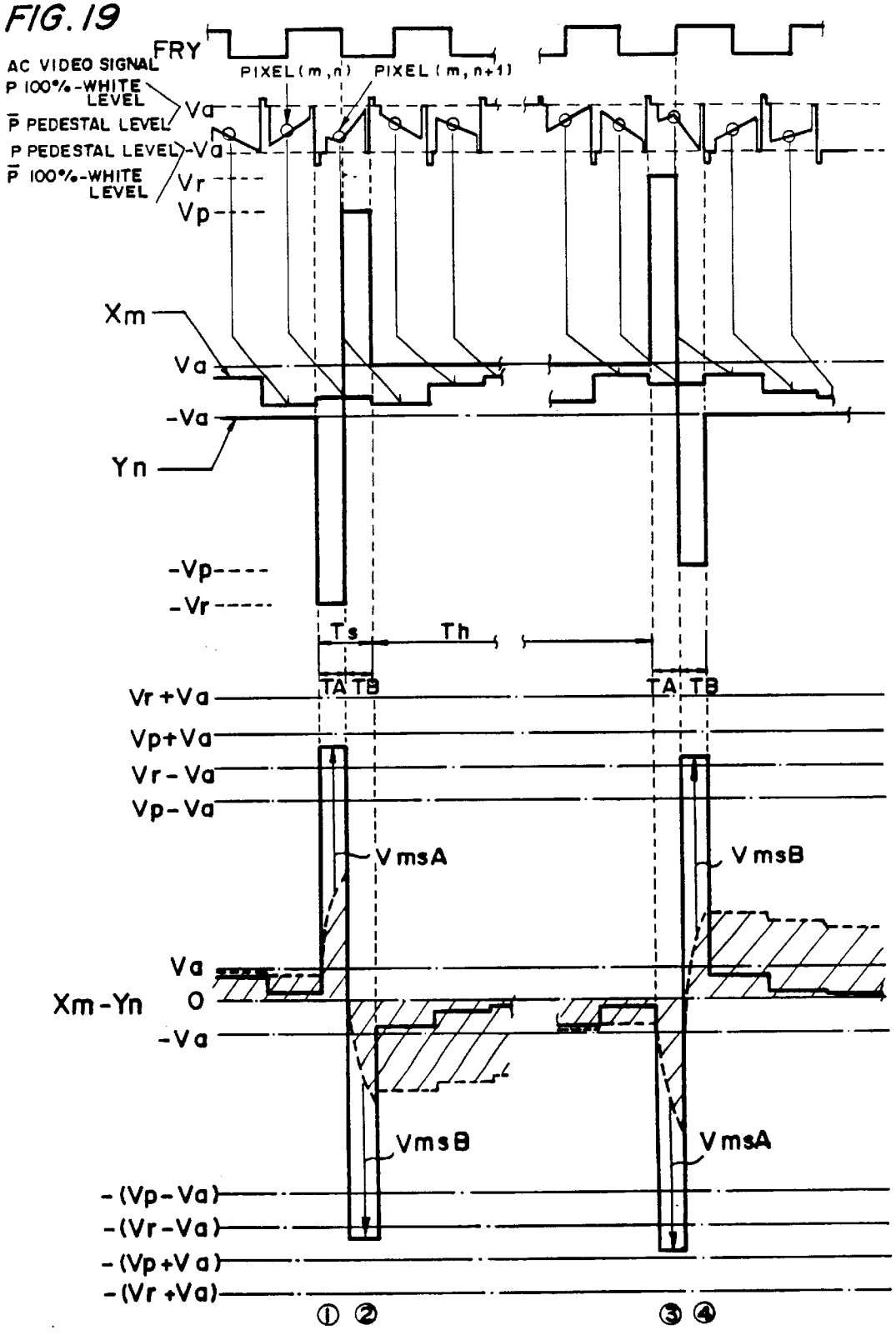
FIG. 19 is a drive waveform diagram of the liquid crystal panel in accordance with the second embodiment of the present invention.

The actual drive created by combining the operation of the above-described Y driver and the X driver will now be described with reference to FIG. 19. FIG. 19 shows the waveforms of signals applied to the pixel that is the mth pixel in the horizontal direction and the nth pixel in the vertical direction, in the liquid crystal panel 115 of FIG. 1, in the same manner as already described for FIG. 6. The column electrode signal Xm sequentially samples the AC video signal 104, holds the data for one horizontal scanning period, then outputs the data, in the same way as in the prior art, so that the output data itself represents the data for the previous horizontal scanning period. The row electrode signal Yn is the same as the signal in FIG. 18, which was described above.

Now look at the difference signal Xm−Yn between the column electrode signal Xm and the row electrode signal Yn, both of which are actually applied to the non-linear element 114 and liquid crystal layer 113. The column electrode signal Xm outputs the same level within one horizontal scanning period but the polarity of the row electrode signal Yn inverts greatly during one horizontal scanning period. Therefore, the polarity of the difference signal also changes greatly between positive and negative, as shown at the bottom of FIG. 19. Therefore, in the same manner as in the first embodiment, there are two selection periods, TA and TB, within one horizontal scanning period. When the non-linear element 114 is selected twice, the second selection determine the gradation value. Therefore, as shown in FIG. 19, it is the selection of the ending period TB that determines the display gradation (in the example on the right-hand side of the figure, this is a write at positive polarity side). This means that, with the drive of FIG. 19, a display gradation (or rather, the root-mean-square value actually applied to the liquid crystal layer 113) has the same effect as that of FIG. 6. The selection data for the initial period TA is the complement of the data of the ending period TB, in the same manner as in the first embodiment. The reason for this is the same as that given for the first embodiment. Therefore, with the drive of FIG. 19, corresponding to the actual selection for determining the display gradation in the ending period TB, the complementary data of the actual selection is written in the compensatory selection in the initial period TA. This operation enables a reduction in afterimages caused by I-V characteristic shift in the non-linear elements.

Figure 20:
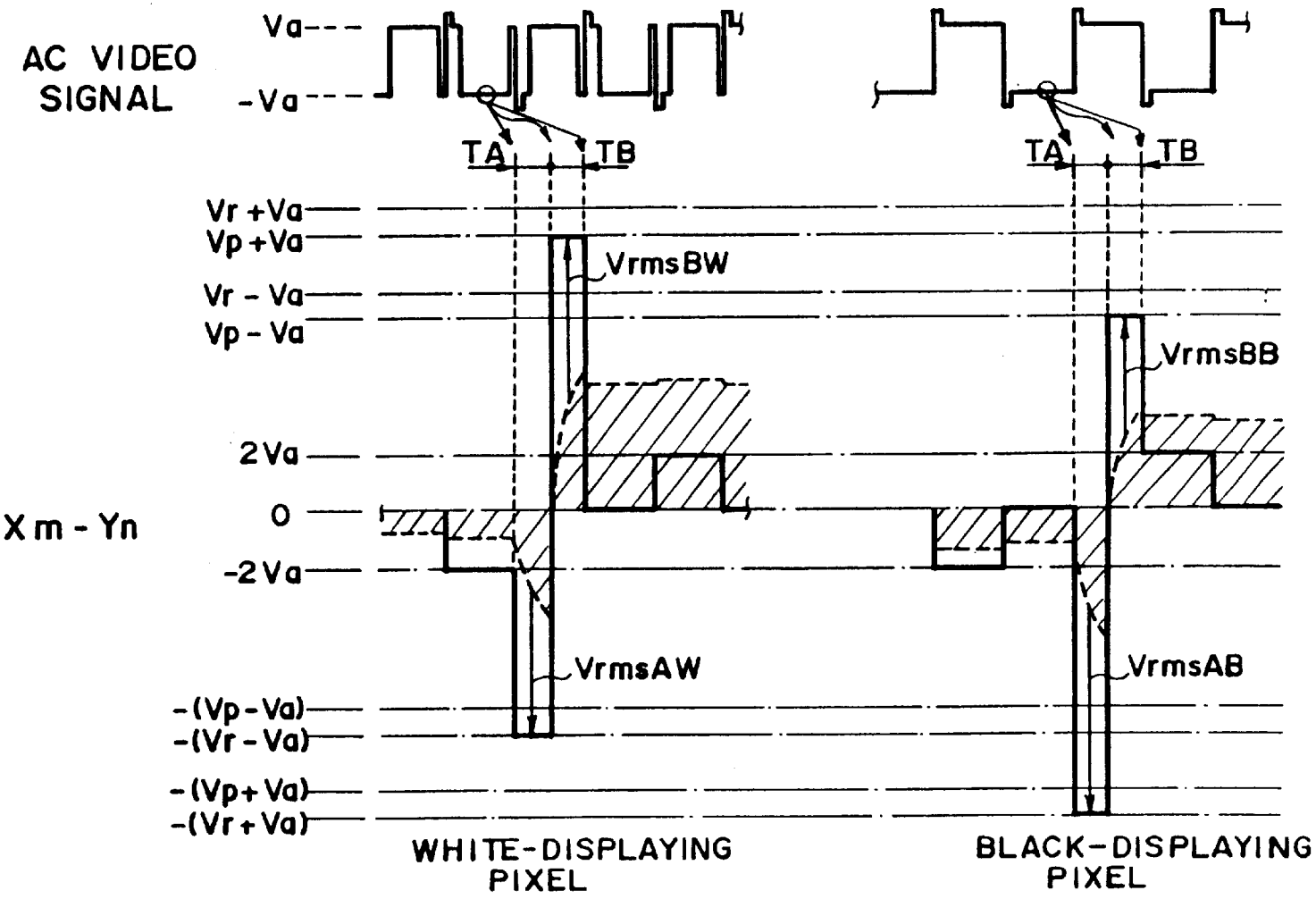
FIG. 20 illustrates the principle of afterimage reduction in accordance with the second embodiment of the present invention.

The principle by which the second embodiment can reduce the afterimages in the non-linear elements caused by I-V characteristic shift will now be described in detail with reference to FIG. 20. The description first concerns a white display, shown in the left-hand side of FIG. 20. In order to show a white display by the pixels, the write potential for the actual selection in the ending period TB is at a maximum at |Vp+Va|. The compensatory selection in the initial period TA writes data that is the complement thereof, and so is at a minimum potential within the compensatory voltage |Vr−Va|. Conversely, when the pixels show a black display (corresponding to the right-hand side of FIG. 20), the write potential for the actual selection in the ending period TB is at a minimum at |Vp−Va|, and the compensatory selection in the initial period TA is at a maximum of |Vp+Va|. When white is selected, a large potential is applied to the non-linear element during the actual selection, but only a small potential is applied to the non-linear element in the preceding compensatory selection. Conversely, when black is selected, the potential to be applied for the actual selection is small, but a large potential is applied to the non-linear element during the compensatory selection. In other words, this means that the total potential applied to the non-linear element can be made the same, regardless of whether black or white is selected.

To be precise, if the effective voltage VmW for white display and the effective voltage VmB for black display that are applied to the non-linear element are made the same, the I-V characteristic shift of the non-linear element can be made uniform, and the phenomenon of afterimages caused by I-V characteristic shift can be eliminated. Writing the conditions of FIG. 20 as an equation gives Equation 3.

Therefore, it is best to determine a selection voltage |Vr| for the compensatory selection that satisfies Equation 3. In general, in the beginning of the compensatory selection period, the potential applied to the non-linear element changes to the compensatory selection potential from that applied in the non-selection period. On the left-hand side of FIG. 20, this potential goes from −2Va to −(Vr−Va); on the right-hand side, it goes from 0 to −(Vr+Va). In the beginning of the actual selection, however, the potential applied to the non-linear element changes much more, from the compensatory selection potential to the actual selection potential. On the left-hand side of FIG. 20, this potential goes from −(Vp−Va) to (Vp+Va); on the right-hand side, it goes from −(Vr+Va) to (Vp−Va). Therefore, a larger potential is applied to the non-linear element for the actual selection, and consequently Vr>Vp.

Figure 21:
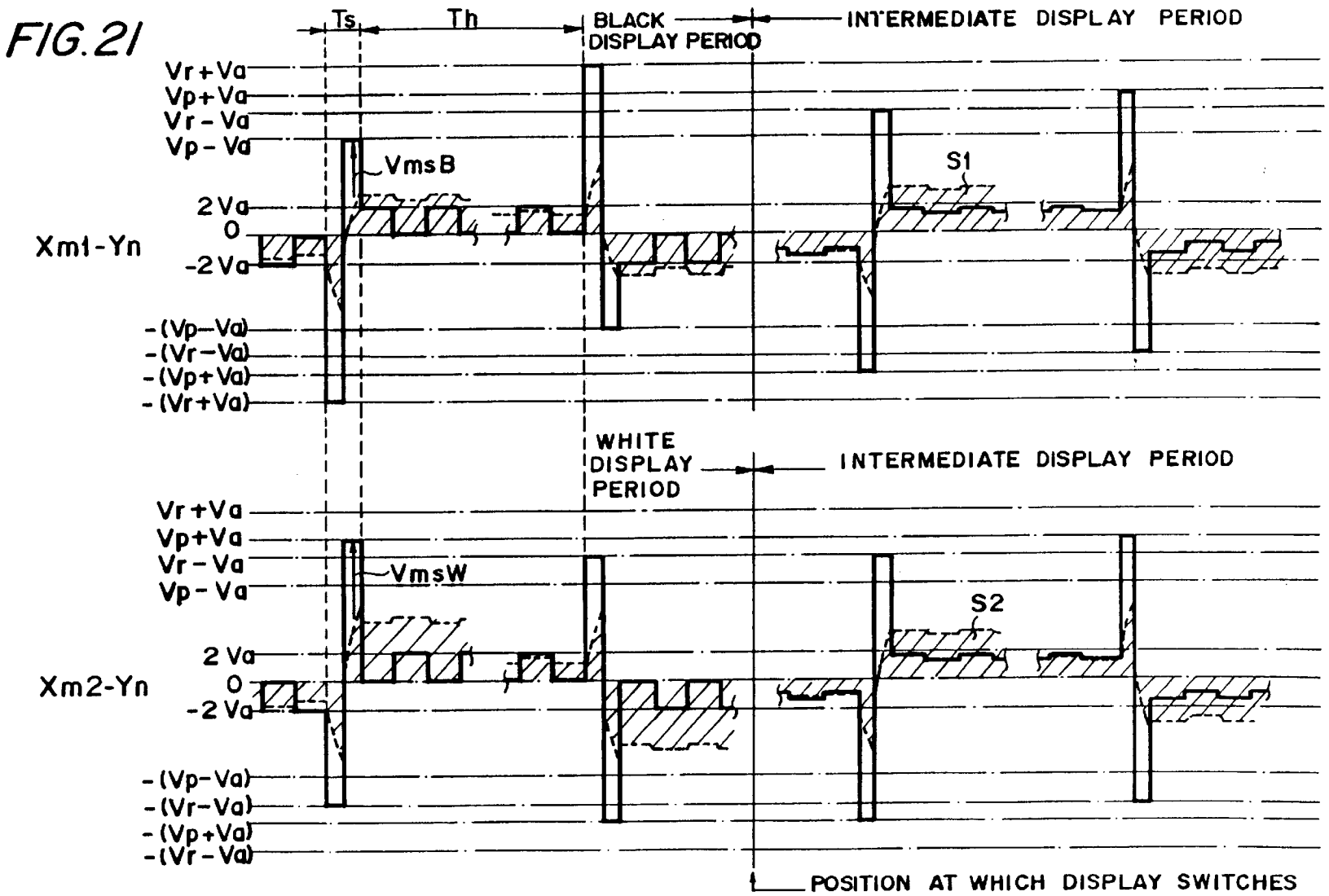
FIG. 21 is a drive waveform diagram used to illustrate that the non-linear element in accordance with the second embodiment of the present invention can reduce afterimages.

The enabling of a dramatic decrease in afterimages due to I-V characteristic shift of the non-linear element will now be described with reference to the example of FIG. 21. In the same way as described with reference to FIG. 10, the signal applied to pixel P1 (in other words, Xm1−Yn) and the signal applied to pixel P2 (in other words, Xm2−Yn) are shown in FIG. 21. Pixel P1 shows a black display and pixel P2 shows a white display. When the display is switched to an intermediate display at this point, the principle described above dictates that the effective voltage VmsB applied to pixel P1 and the effective voltage VmsW applied to pixel P2 are equal, so the magnitude of I-V characteristic shift in these non-linear elements is similarly equal. Therefore, the effective voltage S1 applied to pixel P1 and the effective voltage S2 applied to pixel P2 during intermediate display are also equal, and thus the difference in brightness described with reference to FIG. 10 can be eliminated.

Note that, for the purpose of facilitating understanding of this second embodiment of the present invention, only the cases of black and white display were described, but the present invention is also capable of equalizing the I-V characteristic shift of non-linear elements under all display conditions. This means that the phenomenon of afterimages can be reduced, irrespective of the type of display.

Third Embodiment

A third embodiment of the present invention is an improvement to the drive method used by the liquid crystal display device of FIG. 11.

Figure 22:
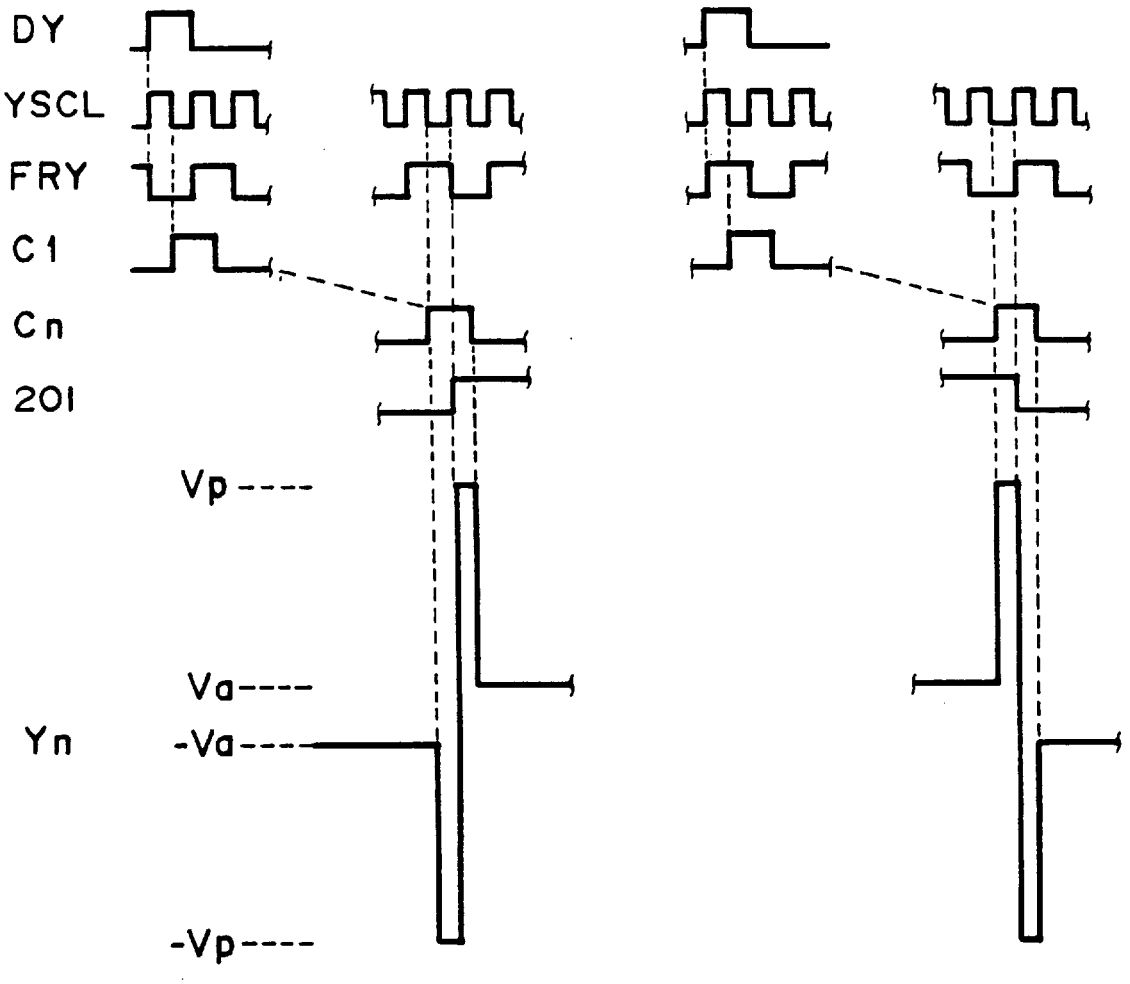
FIG. 22 is a timing chart of driving in the row direction, in accordance with a third embodiment of the present invention.

FIG. 22 is a timing chart of the Y driver which is necessary for carrying out a third embodiment of the present invention.

Figure 5:
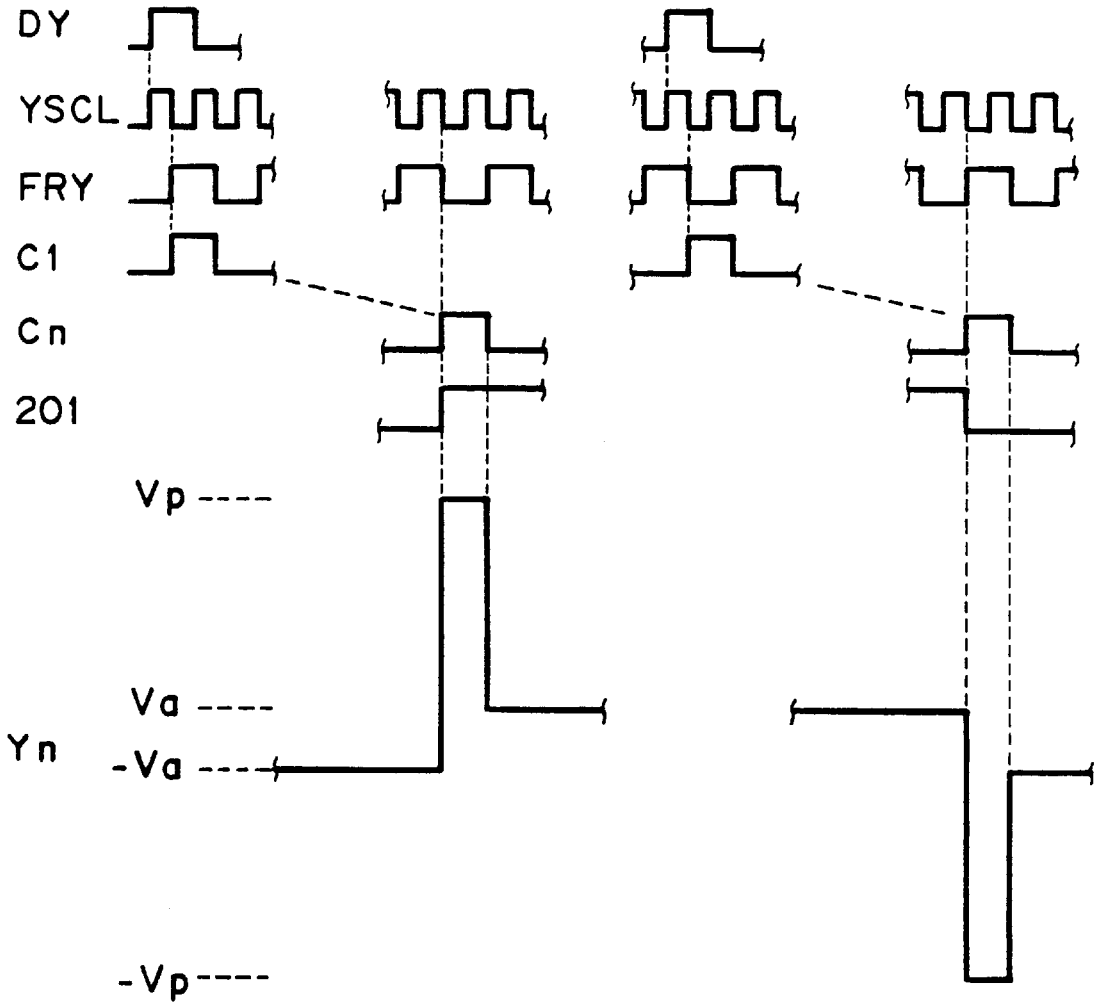
FIG. 5 PRIOR ART
FIG. 5 is a timing chart in accordance with the prior art example of the row drive circuit.

Note that the DY, YSCL, FRY, C1, and Cn signals are the same as those that have already been described with reference to FIG. 5. Y driver outputs the selection voltge signal Vs as the output Vn when the selection signal Cn is 1 in the same way, but in order to carry out this third embodiment, the phase relationship between the selection signal Cn and the AC inversion signal FRY is changed.

The example shown in FIG. 22 differs from that of the first embodiment shown in FIG. 14 in that the switching of FRY is set to be at the center of the period during which Cn is 1, so the duty ratio of Yn is uniform. Note that this duty ratio can be freely selected by changing the phases of Cn and FRY.

Figure 12:
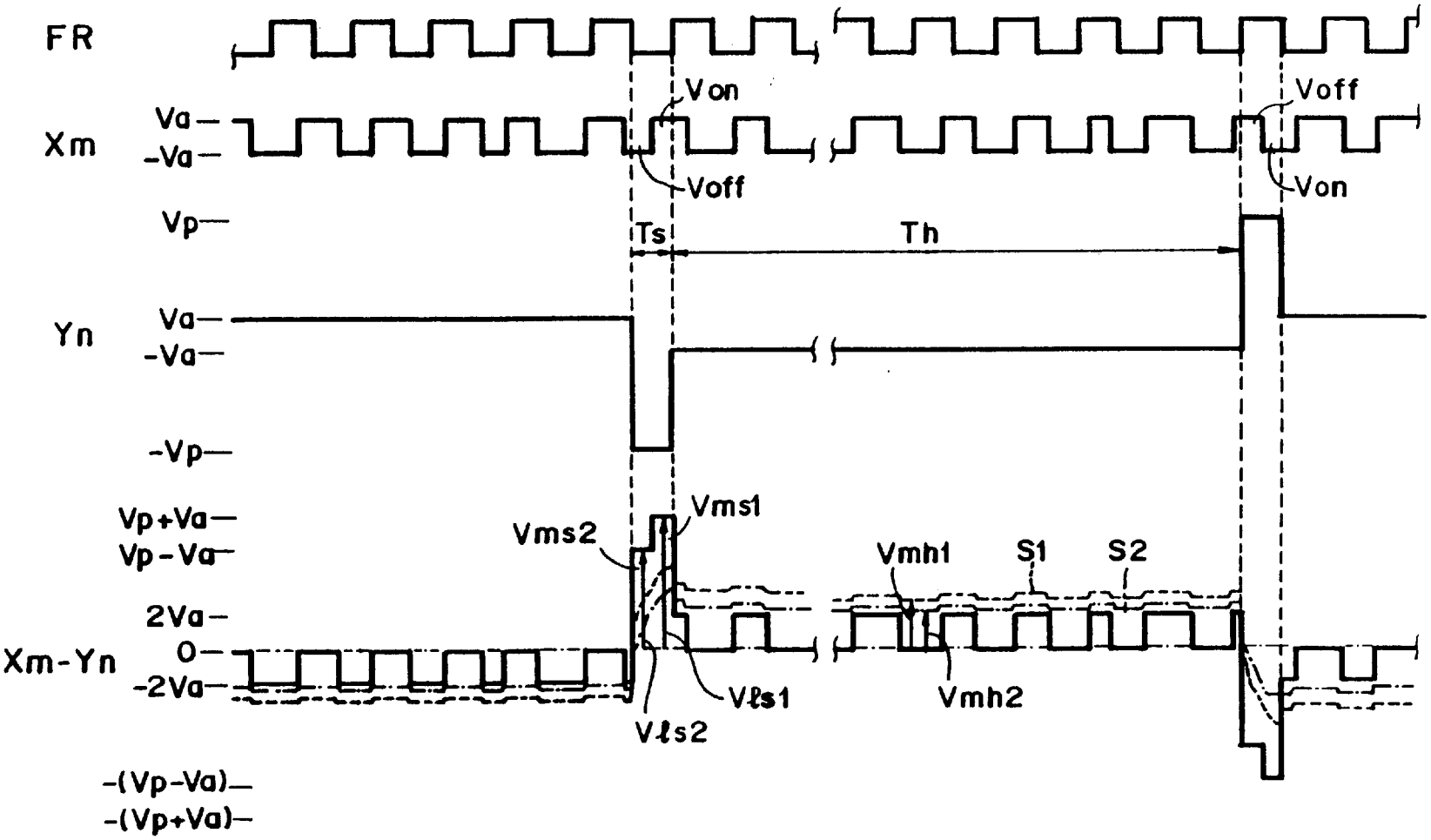
FIG. 12 PRIOR ART
FIG. 12 is a drive waveform chart of the prior art liquid crystal panel used in the device of FIG. 11.
Figure 23:
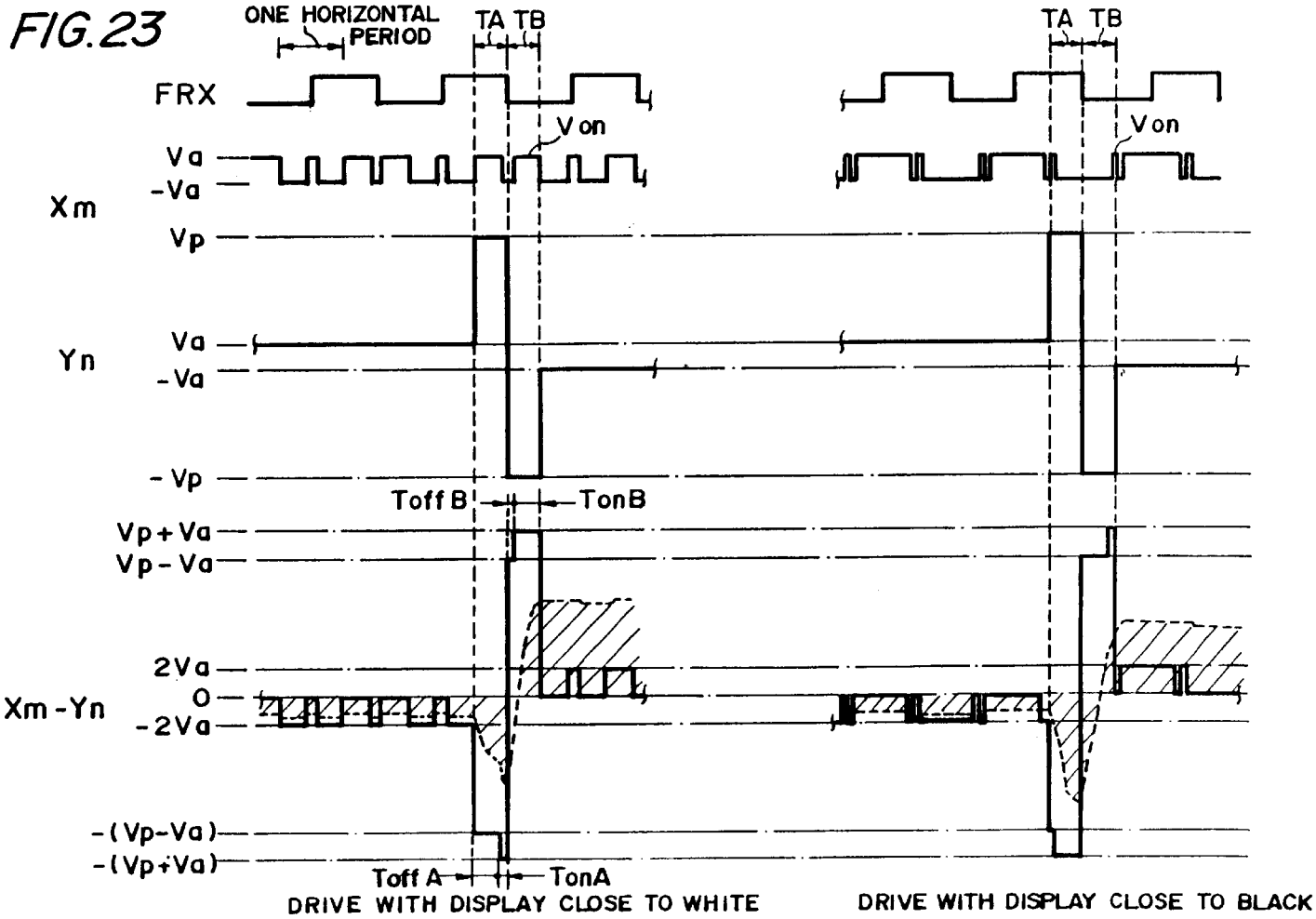
FIG. 23 illustrates the principle of afterimage reduction in accordance with the third embodiment of the present invention.

The actual drive created by combining the operation of the above-described Y driver and the X driver will now be described with reference to FIG. 23. FIG. 23 shows the waveforms of signals applied to the pixel that is the mth pixel in the horizontal direction and the nth pixel in the vertical direction, in the liquid crystal panel 115 of FIG. 11, in the same manner as already described for FIG. 12. The column electrode signal Xm sequentially samples the video signal in the A/D converter 120 and outputs Von and Voff periods based on that data. In this third embodiment, one horizontal scanning period is divided into two parts, TA and TB, with the selection data for the initial period TA being the complement of the data of the ending period TB. Since the AC inversion signal FRX switches within one horizontal scanning period, the data of the initial part of the actual column electrode signal is symmetrical with the ending data about the axis of this switch in FRX. Therefore, the potential Von of the column electrode signal Xm in the write period TB is Va in the waveform shown in FIG. 23 so that a relatively large voltage is applied to the pixel in connection with the polarity of the scanning signal in the period TB, but the column electrode signal Xm has a potential Von of a substantially equal pulse width in each of the periods TA and TB. The description of this embodiment deals with the case in which TA=TB (and thus TA=TB=½ horizontal scanning period), but the drive of the third embodiment of the present invention can equally well be applied to the case in which TA≠TB. The row electrode signal Yn is the signal described with reference to FIG. 22.

Since the polarity of the row electrode signal Yn inverts hugely in one horizontal scanning period, the polarity of the difference signal Xm−Yn between the column electrode signal Xm and the row electrode signal Yn, both of which are actually applied to the non-linear element 114 and liquid crystal layer 113 also changes greatly between positive and negative, as shown at the bottom of FIG. 23. It can be seen from this figure that the pixel is selected twice, i.e., in two selection periods, TA and TB, within one horizontal scanning period. In FIG. 23 too, it is the selection of the ending period TB that determines the display gradation (in the example on the right-hand side of FIG. 23, this is a write at positive polarity side). This means that, with the drive of FIG. 23, a display gradation (or rather, the root-mean-square value actually applied to the liquid crystal layer 113) has the same effect as that of FIG. 12.

In the drive example in accordance with the third embodiment of the present invention as well, the compensatory selection in the initial period TA is the complement of the actual selection in the ending period TB. When the mode of display is the negative display, the left-hand side of FIG. 23 shows an example where the pixel shows an intermediate display close to white. In the selection of the ending period TB, the ratio of Von to Voff is comparatively large and thus a large root-mean-square value is applied to the liquid crystal layer 113 of FIG. 11. However, since the complementary data described above is selected in the selection in the initial period TA, a wide pulse of the same potential as the potential Von in the ending period TB functions as the Voff potential when it is applied to the pixel, so that in effect the selection is such that the ratio with Von is small. Conversely, in the example shown on the right-hand side of FIG. 23, where the pixels' showing is close to black, the ratio of Von to Voff in the actual selection in the ending part is small and thus a comparatively small root-mean-square value is applied to the liquid crystal layer 113. However, for the same reason as described above, the selection in the compensatory selection of the ending part is in effect at a ratio of Von to Voff that is large.

To summarize the above description: in the selection for an intermediate display close to white where a large root-mean-square value is required for the liquid crystal layer, the root-mean-square value of the compensatory selection of the initial part is small. Conversely, for a selection for an intermediate display close to black, the root-mean-square value of the compensatory selection of the initial part is large. In other words, in order to compensate in the compensatory selection of the initial part for the actual selection in the ending part that is necessary for the actual display, the root-mean-square values applied to the non-linear element 114 that is changing from white to black can be made to be substantially uniform. This operation enables a reduction in afterimages caused by I-V characteristic shift in the non-linear elements.

To be precise, if the effective voltage VmW for white display and the effective voltage VmB for black display that are applied to the non-linear element are made the same, the I-V characteristic shift of the non-linear element can be made uniform, and the phenomenon of afterimages caused by I-V characteristic shift can be eliminated. Writing the conditions of FIG. 23 as an equation gives Equation 3, in the same way as with the first and second embodiments.

Therefore, it is best to ensure that the values of the periods TA and TB of the compensatory selection and the actual selection satisfy this equation. Note that if TA=TonA+ToffA and TB=TonB+ToffB and the ratio TonA/ToffA is substantially the reciprocal of TonB/ToffB, the data of the compensatory selection is the complement of the data of the actual selection. In general, in the beginning of the compensatory selection period, the potential applied to the non-linear element changes to the compensatory selection potential from that applied in the non-selection period. On the left-hand side of FIG. 23, this potential goes from −2Va to −(Vp−Va); on the right-hand side, it goes from 0 to −(Vp+Va). In the beginning of the actual selection, however, the potential applied to the non-linear element changes much more, from the compensatory selection potential to the actual selection potential. On the left-hand side of FIG. 23, this potential goes from −(Vp−Va ) to (Vp+Va); on the right-hand side, it goes from −(Vp+Va) to (Vp−Va). Therefore, a larger potential is applied to the non-linear element for the actual selection, and consequently TA>TB.

Figure 13:
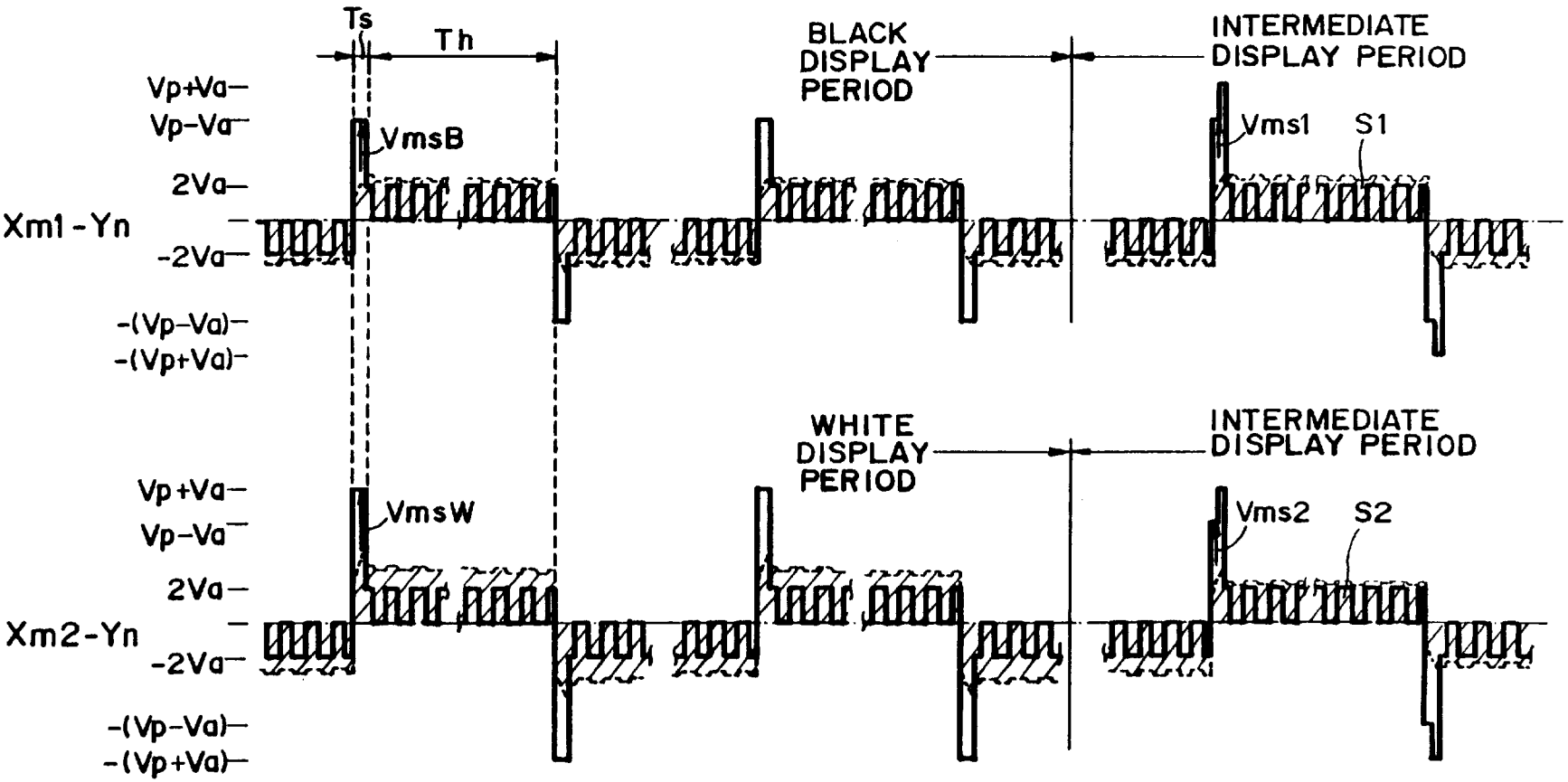
FIG. 13 PRIOR ART
FIG. 13 is a drive waveform chart in accordance with the prior art example, illustrating the generation of an afterimage due to the I-V characteristic shift of non-linear elements.
Figure 24:
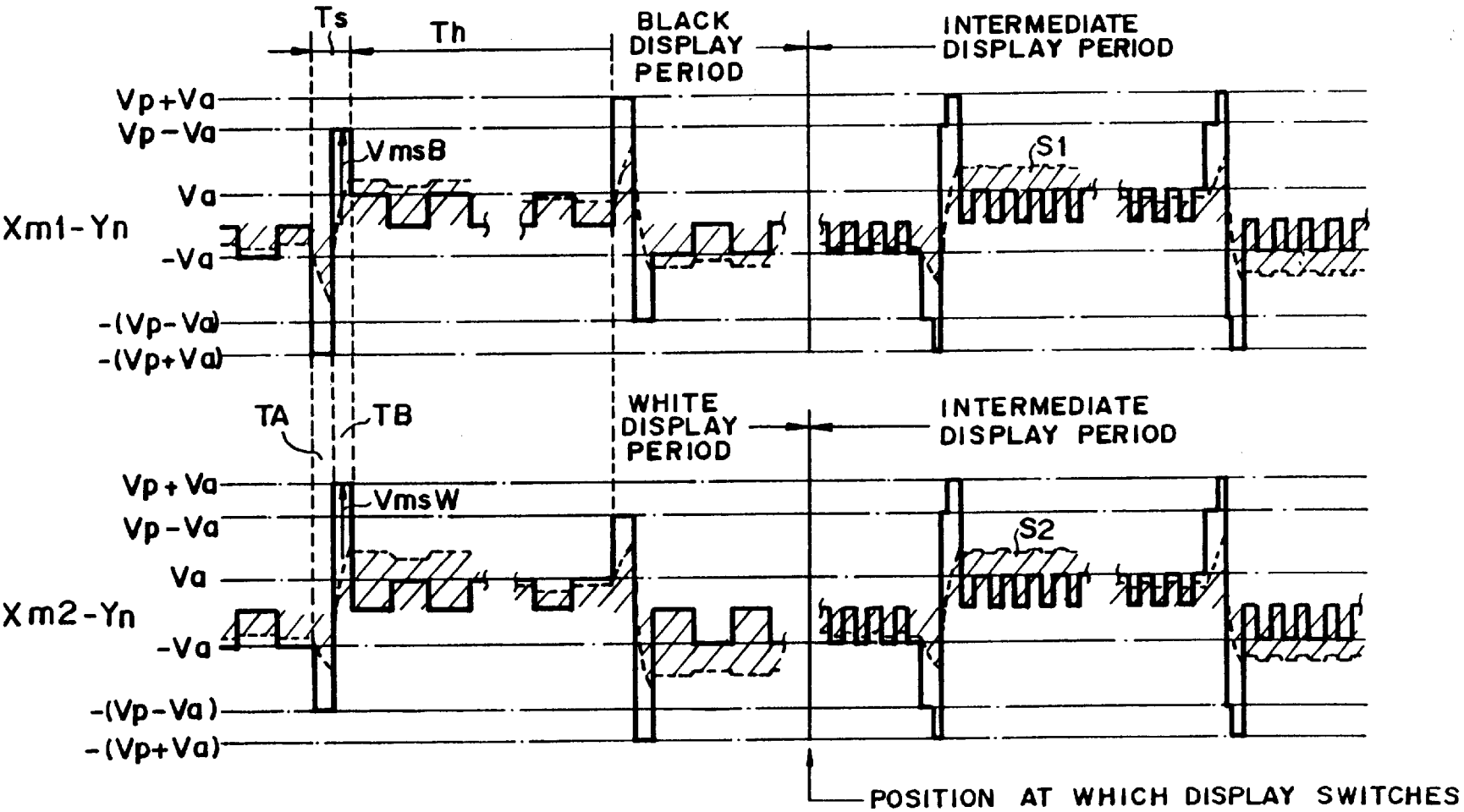
FIG. 24 is a drive waveform diagram using to illustrate that the non-linear element in accordance with the third embodiment of the present invention can reduce afterimages.

The enabling of a dramatic decrease in afterimages due to I-V characteristic shift of the non-linear element will now be described with reference to the example of FIG. 24. In the same way as described with reference to FIG. 13, the signal applied to pixel P1 (in other words, Xm1−Yn) and the signal applied to pixel P2 (in other words, Xm2−Yn) are shown in FIG. 24. Pixel P1 shows a black display and pixel P2 shows a white display. When the display is switched to an intermediate display at this point, the principle described above dictates that the effective voltage VmsB applied to pixel P1 and the effective voltage VmsW applied to pixel P2 are equal, so the magnitude of I-V characteristic shift in these non-linear elements is similarly equal. Therefore, the effective voltage S1 applied to pixel P1 and the effective voltage S2 applied to pixel P2 during intermediate display are also equal, and thus the difference in brightness described with reference to FIG. 13 can be eliminated.

Note that, for the purpose of facilitating understanding of this third embodiment of the present invention, only the cases of black and white display were described, but the third embodiment of the present invention is also capable of equalizing the I-V characteristic shift of non-linear elements under all display conditions. This means that the phenomenon of afterimages can be reduced, irrespective of the type of display.

Fourth Embodiment

Figure 25:
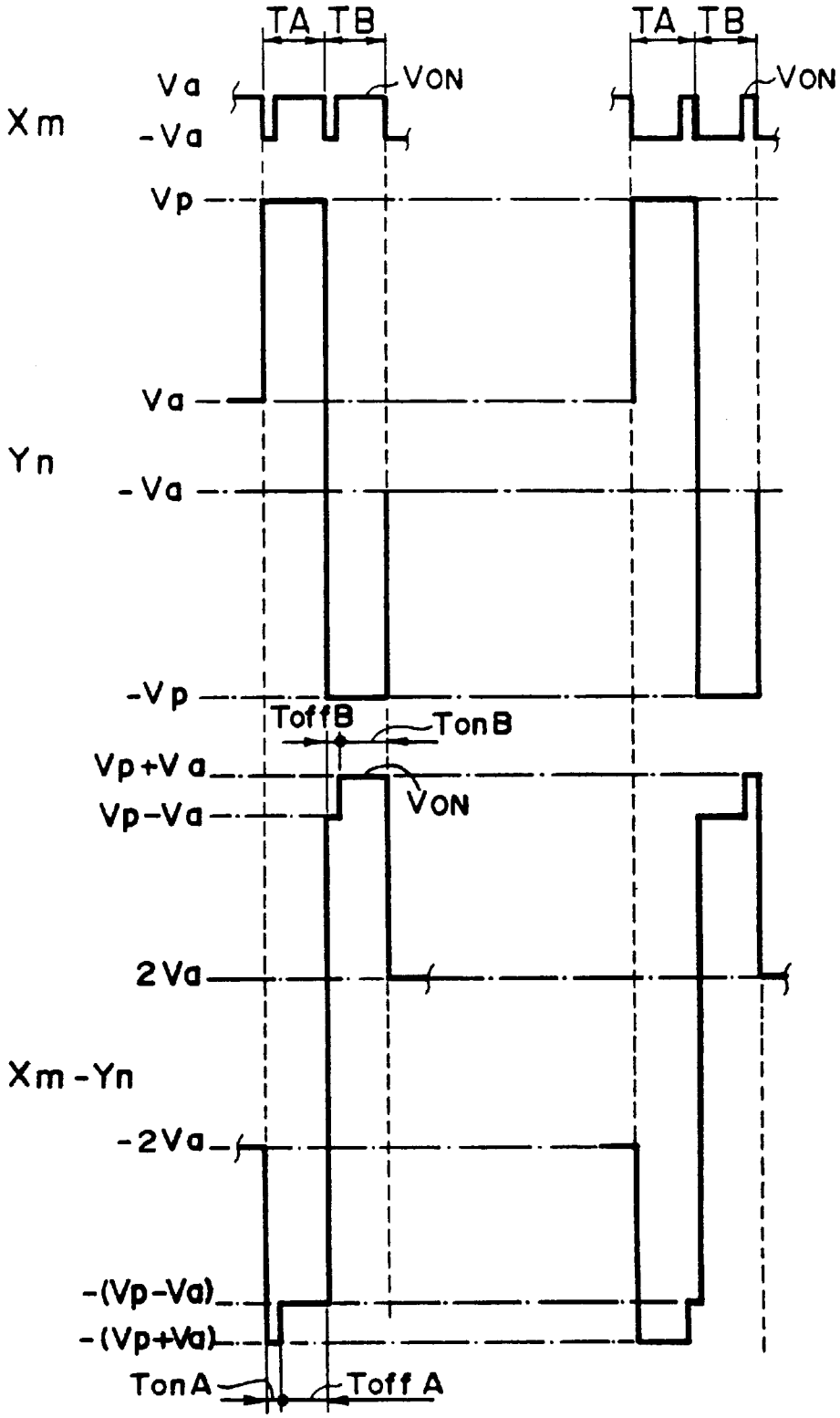
FIG. 25 is a drive waveform diagram of a liquid crystal panel in accordance with the fourth embodiment of the present invention.

A fourth embodiment of the present invention concerns a case where the signal waveform of the difference signal Xm−Yn is changed as shown in FIG. 25 by changing the waveform of the column electrode signal Xm in FIG. 23, which is the timing chart of the third embodiment In the third embodiment of the present invention, the data of the initial period TA which is the compensatory selection is symmetrical with the data of the ending period TB which is the actual selection, about the axis of the switch in FRX, as shown in the column electrode signal Xm of FIG. 23. In this fourth embodiment of the present invention, the same data is temporally compressed into, for example, half the horizontal scanning period and is output twice in succession within one horizontal scanning period, as shown by the column electrode signal Xm of FIG. 25. As a result, in contrast to the difference signal Xm−Yn of the third embodiment shown in FIG. 23, in which the period TonA that governs Von of the compensatory selection is on the right of the period TA of the compensatory selection, that of the fourth embodiment shown in FIG. 25 is such that the period TonA that governs Von of the compensatory selection is on the left of the period TA.

Figure 26:
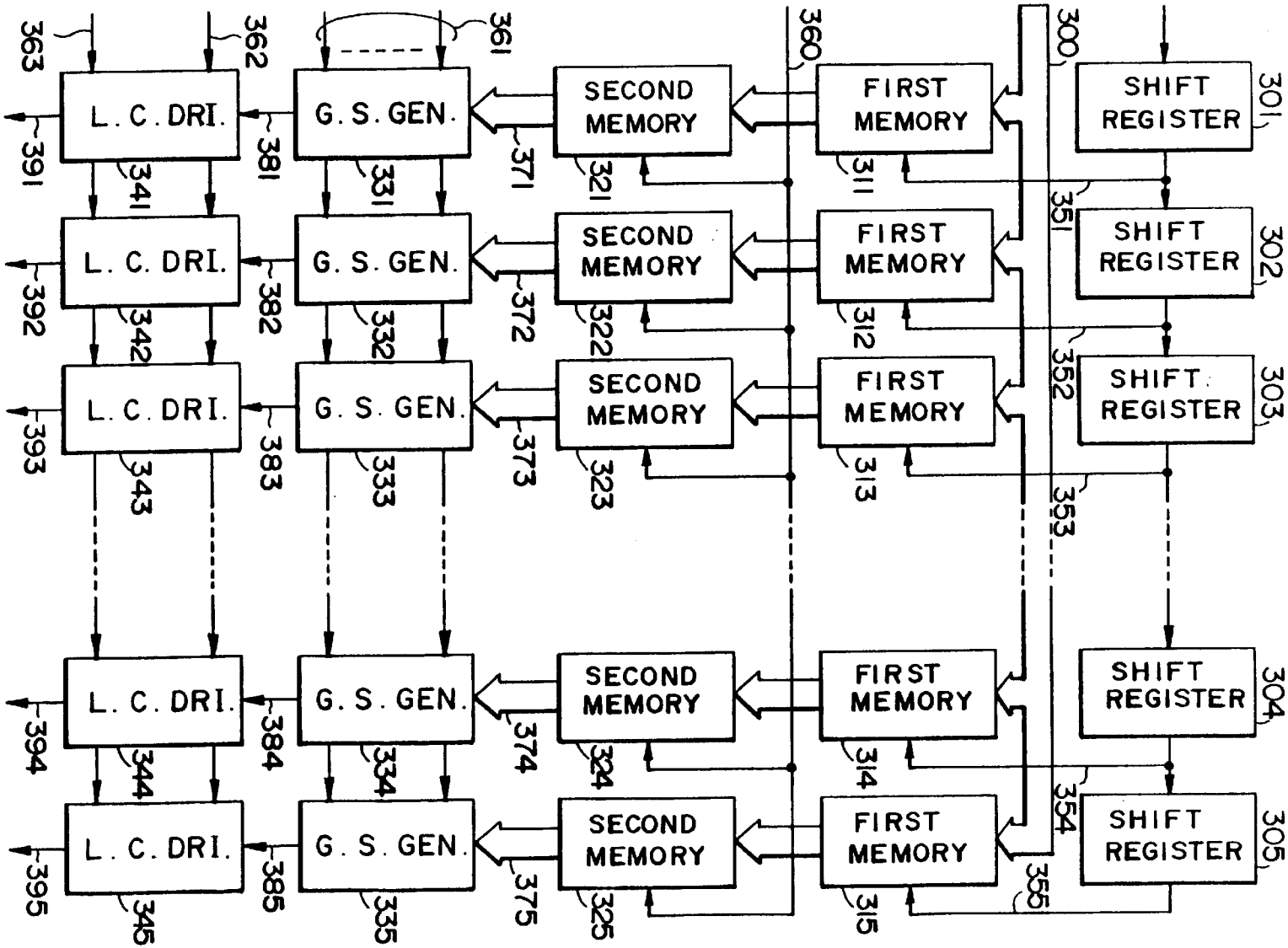
FIG. 26 is a circuit diagram of an X driver using the fourth embodiment of the present invention.

A configuration example of the X driver that outputs the column electrode signal Xm shown in FIG. 25 is shown in FIG. 26. This figure shows a drive circuit that supplies an M-bit video data signal to each of N data lines. In this figure, reference number 300 denotes a data bus that supplies the M-bit video data signal which inverts in N cycles within one field, as shown by 421 in FIG. 27. The M-bit video data signal is written to first memories 311 to 315 corresponding to addresses determined in accordance with the outputs of N-stage shift registers 301 to 305. Reference numbers 351 to 355 in FIG. 26 denote output signals from the shift registers 301 to 305, respectively. The output signals 351 to 355 are usually at 0 but become 1 once only within one field to write the contents of the data bus 300 to the corresponding first memories 311 to 315.

Figure 27:
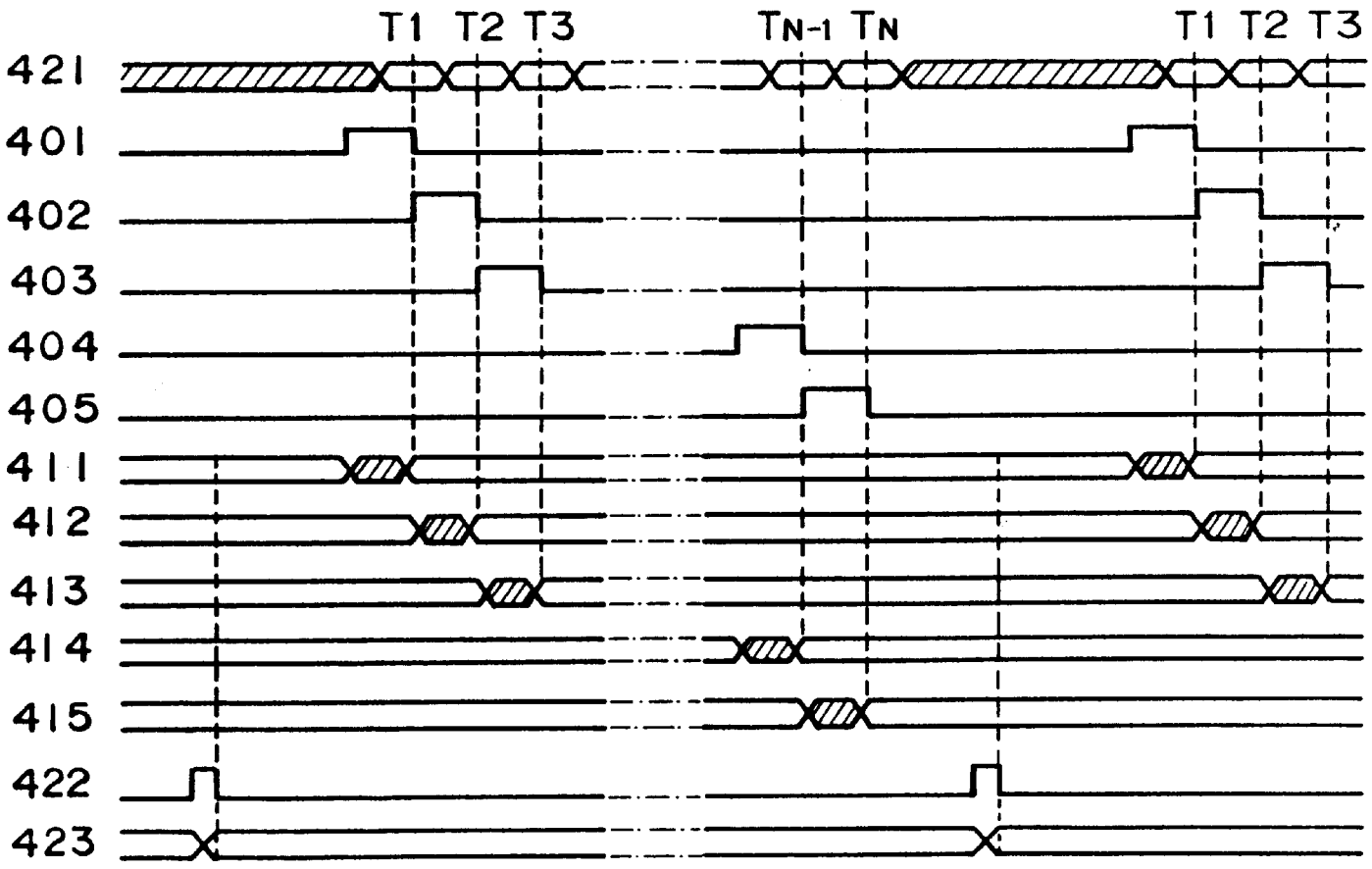
FIG. 27 is a characteristic graph used to illustrate the signal changes in the various components of FIG. 26.

The timing chart of FIG. 27 illustrates this state, where the output signals of the shift registers 301 to 305 are shown as reference numbers 401 to 405, respectively. The contents of the data stored in each of the first memories 311 to 315 are shown as reference numbers 411 to 415, respectively. Note that the shading in FIG. 27 denotes an undetermined status.

In FIG. 26 and FIG. 27, the video data signal on the data bus 300 is written to memory 311 at a timing T1, to memory 312 at a timing T2, and to memory 313 at a timing T3. Thereafter, video data is written to each memory in turn until data is written to the final-stage memory 315 at a timing Tn, which completes the operation of writing video data to memory in this field. This one field of video data is equivalent to the video data for one scan line.

In FIG. 26, a latch pulse (LP) 360 is input to second memories 321 to 325. This latch pulse 360 acts to transfer the data that is in the first memories 311 to 315 to the second memories 321 to 325. The signal waveform of the latch pulse 360 is shown as reference number 422 in FIG. 27. During the time that this latch pulse 422 is high level, the data in the first memories 311 to 315 is written in a batch to the second memories 321 to 325. During the time it is low level, the data in the second memories 321 to 325 is held stable, as shown by data 423 in FIG. 27.

The operation that generates the column electrode signal Xm shown in FIG. 25, based on the data in the second memories 321 to 325, will now be described with reference to the timing chart of FIG. 28.

The second memories 321 to 325 each output M-bit data signals 371 to 375, as shown in FIG. 26. These M-bit data signals 371 to 375 and a basic pulse train 361 (which form constituent elements of a grayscale signal) are combined by grayscale signal generation circuits 331 to 335 to generate individual-stage grayscale signals 381 to 385 (in other words, the column electrode signal Xm).

Figure 28:
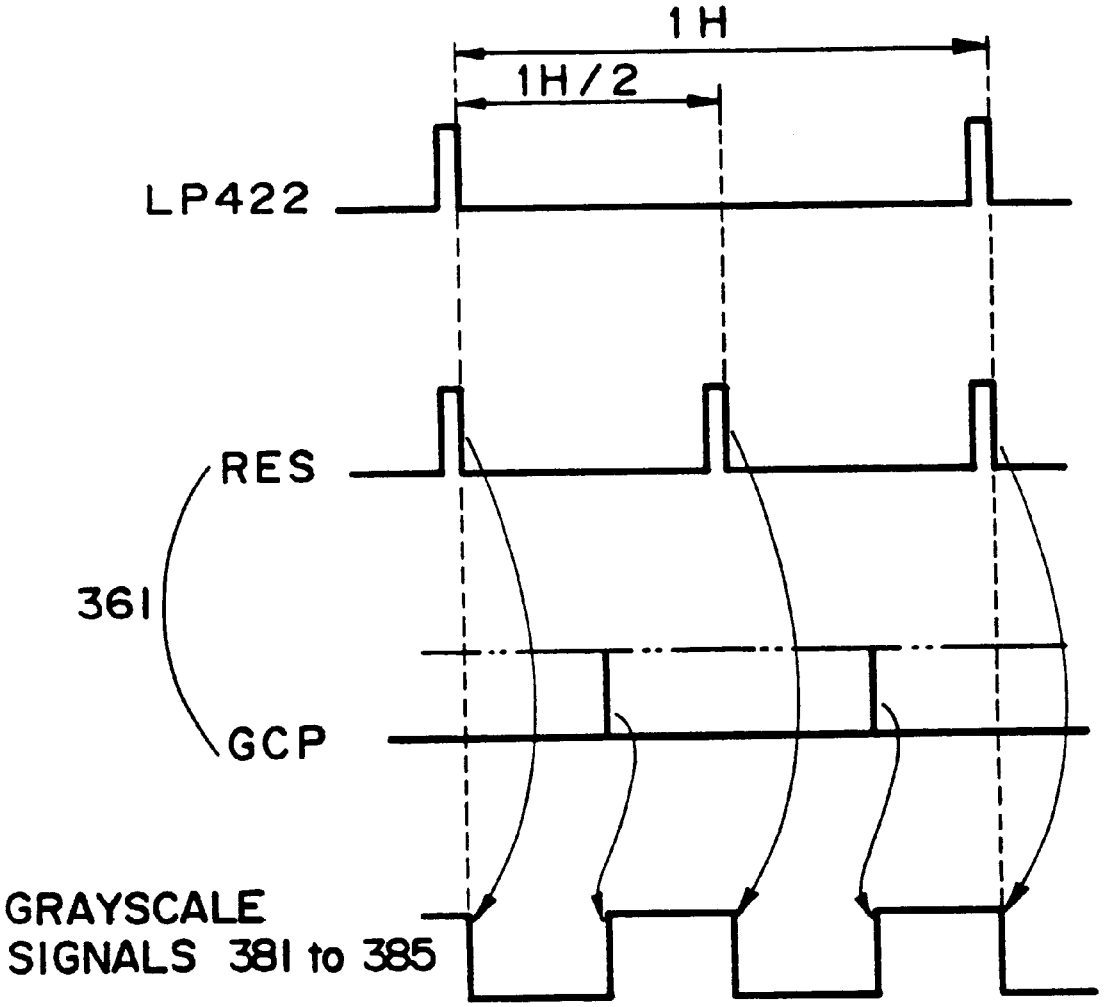
FIG. 28 is a timing chart of the operation of the grayscale signal generation circuit of FIG. 26.

In this case, the basic pulse train 361 comprises a reset signal RES and a GCP signal formed of, for example, $2^M$ pulses of a different pulse width, as shown in FIG. 28. The reset signal RES has a pulse that goes high at the initial-period position and final-period position of the horizontal scanning period, in the same manner as the latch pulse 422, as shown in FIG. 28, and it also has a pulse at the central position of the horizontal scanning period. The GCP signal are output in succession in one horizontal scanning period as two identical signals, each compressed into the time of half the horizontal scanning period. The reset signal RES and the GCP signal compound the outputs from the second memories 321 to 325, as shown in FIG. 28, the signal 381 to 385 can be generated in the form of a uniform waveform which reflects the grayscale data is output sequentially within the horizontal scanning period so that the signals 381 to 385 can be generated. Note that these grayscale signal generation circuits 331 to 335 can invert the polarity of the data 381 to 385 within the horizontal scanning period, based on the polarity inversion signal (FR).

The outputs 381 to 385 of the grayscale signal generation circuits 331 to 335 are input to liquid crystal drive circuits 341 to 345. These liquid crystal drive circuits 341 to 345 generate liquid crystal drive signals 391 to 395 (i.e., the column electrode signal Xm) of levels that are shifted from the grayscale signals 381 to 385 in accordance with a voltage level 362 (i.e., Va or −Va) that turns the liquid crystal on and a voltage level 363 (i.e., −Va or Va) that turns the liquid crystal off.

Figure 37:
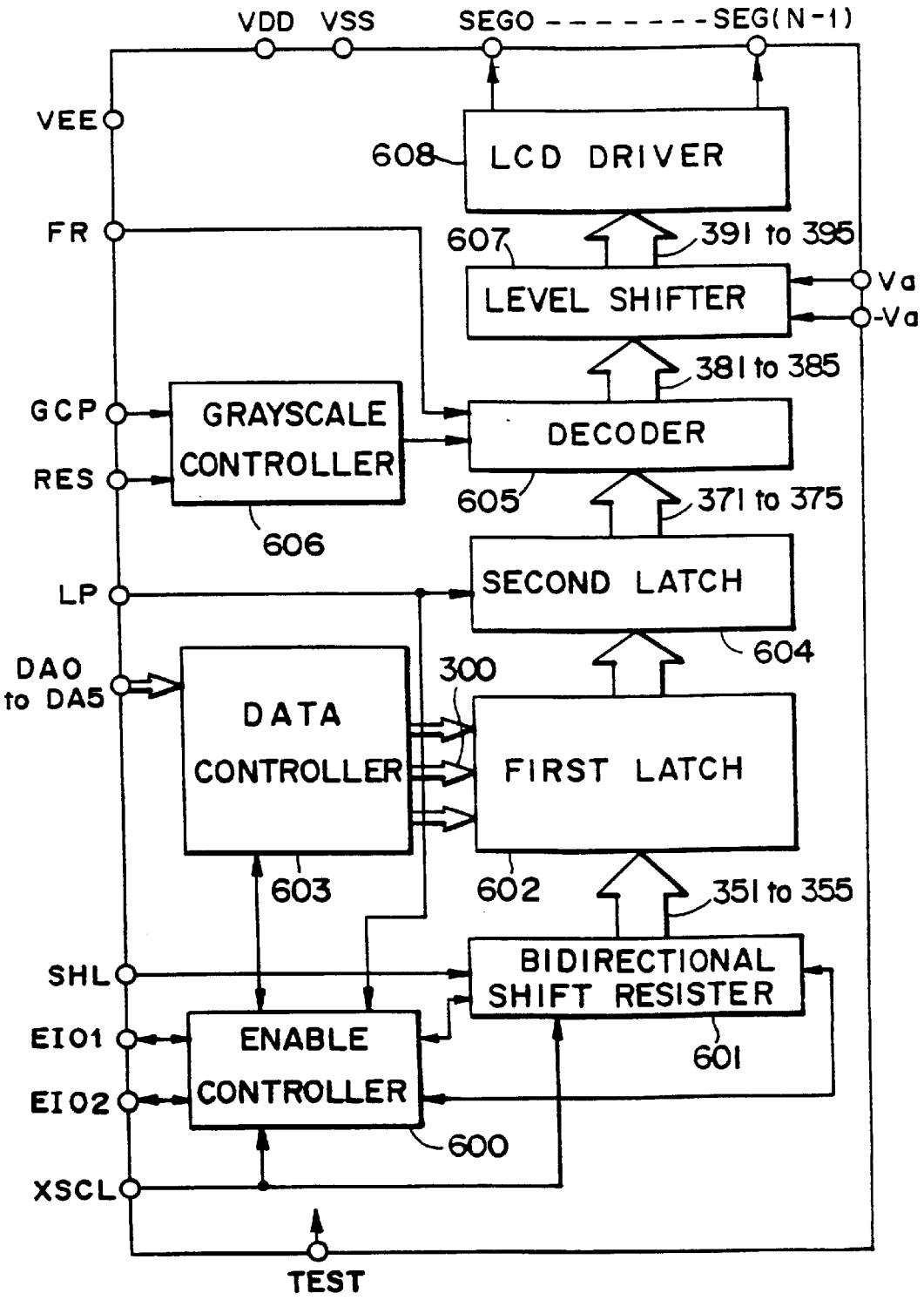
FIG. 37 is a circuit diagram of a variation of the X driver using in the fourth embodiment of the present invention.

The X driver that outputs the column electrode signal Xm shown in FIG. 25 can be configured as shown in FIG. 37. In this figure, a bidirectional shift register 601, a first latch 602, a second latch 604, a decoder 605, a level shifter 607, and an LCD driver 608 correspond to the shift registers 301 to 305, the first memories 311 to 315, the second memories 321 to 325, the grayscale signal generation circuits 331 to 335, and the liquid crystal drive circuits 341 to 345, respectively, of FIG. 26. In FIG. 37, an enable controller 600 controls the bidirectional shift register 601 and a data controller 604 at the timing of a signal such as the latch pulse LP, to implement the data transfer of FIG. 27.

The circuitry of FIG. 37 differs from that of FIG. 26 in that GCP is not a signal having a $2^M$ pulse width, it is a signal having a pulse at a $2^M$th position in accordance with grayscale value, and in that the decoder 605 that inputs the GCP signal through a grayscale controller 606 detects data 371 to 375 output from the second latch 604 together with the GCP signal to generate the grayscale signals 381 to 385 shown in FIG. 28. Except for these points, the operation of the circuit of FIG. 37 is the same as that shown in the timing chart of FIG. 28.

In this way, the fourth embodiment of the present invention can easily generate the column electrode signal Xm that is configured by outputting a waveform which reflects the grayscale data twice in succession within one horizontal scanning period, using the relatively simple drive circuit shown in either FIG. 26 or FIG. 37. It can also shape the difference signal Xm−Yn of the column electrode signal Xm and the row electrode signal Yn (shown in FIG. 25) in such a manner that the period TonA for Von in the compensatory period TA is on the left of the compensatory period TA. Note that in this fourth embodiment too, the difference signal Xm−Yn shown in FIG. 25 divides the horizontal scanning period into two periods, TA and TB, and the initial-part and ending-part data is in a complementary relationship. This enables a reduction in afterimages caused by I-V characteristic shift in the non-linear elements, in the same way as in the third embodiment.

The drive circuit shown in FIG. 26 and used in this fourth embodiment is simple to construct, as can easily be understood by a comparison with the drive circuit of the third embodiment for generating the column electrode signal Xm shown in FIG. 23. The waveform of the column electrode signal Xm used in the third embodiment is shown in FIG. 29A. It reflects the grayscale data, but it has also been made symmetrical about the boundary between the periods TA and TB. An example of the configuration of the drive circuit for generating the waveform of FIG. 29A is shown in FIG. 29B. In this case, a comparatively large memory such as a first-in, first-out (FIFO) memory 501 is necessary. The video signal that is the input signal to the FIFO memory 501 is shown in FIG. 29C, and the output signal from the FIFO memory 501 is shown in FIG. 29D. The read clock of the FIFO memory 501 is set to be at twice the speed of the write clock thereof. As a result, the output signal from the FIFO memory 501 has a timing that is delayed by half the horizontal scanning period with respect to the input signal shown in FIG. 29C, and the video signal of FIG. 29C is compressed to half along the time axis so that the same signal waveform is output twice in succession. The output from the FIFO memory 501 is input to an X driver 503 via a signal processing circuit 502 that processes signal on the basis of an AC inversion signal FRX, so that the symmetrical pulse waveform shown in FIG. 29A can be output as the column electrode signal Xm.

Fifth Embodiment

A fifth embodiment of the present invention concerns an improvement which ensures that any noise caused by the difference signal Xm−Yn of the first to fourth embodiments (or rather, by the huge change in potential that occurs at the boundary between the periods TA and TB) does not appear on the liquid crystal panel 115.

Figure 30:
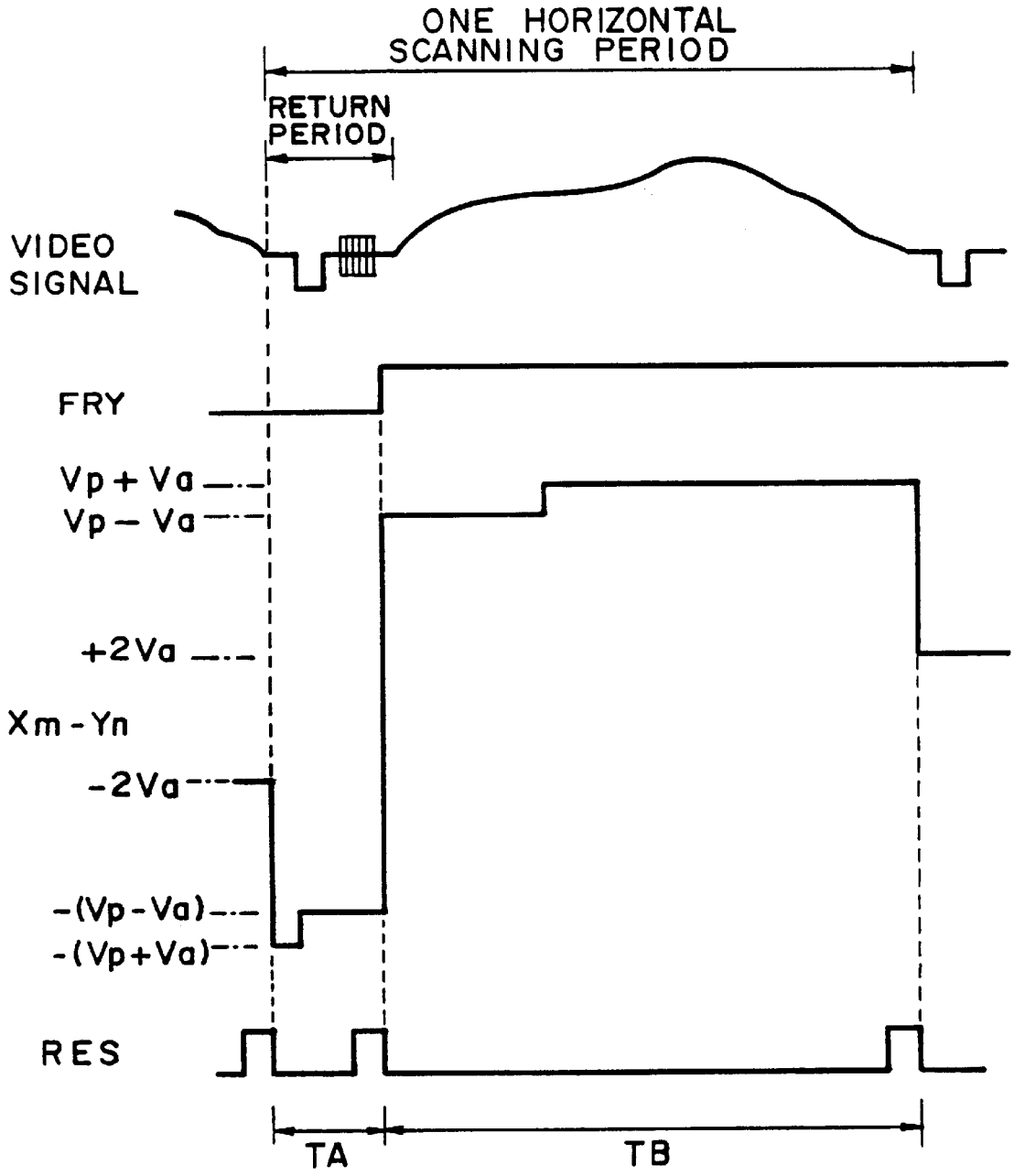
FIG. 30 is a drive waveform diagram used to illustrate a fifth embodiment of the present invention.

At the boundary between the periods TA and TB in the difference signal Xm−Yn, the voltage experiences a huge shift from a negative potential to a positive one, as shown in FIG. 30. It is feared that this huge potential difference generated in the liquid crystal display device will be superimposed as noise in the video circuitry of the previous stage, and also in the tuner circuitry and antenna of earlier stages, and will eventually appear as noise on the liquid crystal screen. It is possible to remove this noise by providing an exclusion circuit in the video circuitry, for example, but this would make the structure complicated. The fifth embodiment of the present invention solves this problem by placing the compensatory selection period TA of the difference signal Xm−Yn so that it is included within the flyback period of the video signal. In terms of the relationship between the compensatory selection period TA and the horizontal scanning period (TA+TB), this can be expressed by:

$$TA/(TA+TB) \leqq 1/4.$$

Even more preferably, it is best if TA is no more than 15% of (TA+TB), to ensure that the width of the period TA substantially matches the width of the flyback signal.

As shown in FIG. 30, the video signal and the difference signal Xm−Yn are synchronized. Therefore, by making sure that the above equation is satisfied, the compensatory selection pulse (i.e., the compensatory selection period TA) within the difference signal can be set to substantially correspond to the flyback signal of the video signal along the time axis. Then, even if noise caused by the huge potential difference within the difference signal Xm−Yn is superimposed on the video signal, it is superimposed on the signal during the flyback period. The signal within this flyback period is not displayed on the liquid crystal screen, and thus it does not appear as noise on the liquid crystal screen.

Sixth Embodiment

A sixth embodiment of the present invention concerns an improvement to the drive waveform of the column electrode signal Xm, whereby the voltages applied to the two ends of the non-linear element and the liquid crystal layer are made even larger during the compensatory selection than during the actual selection.

Figure 31:
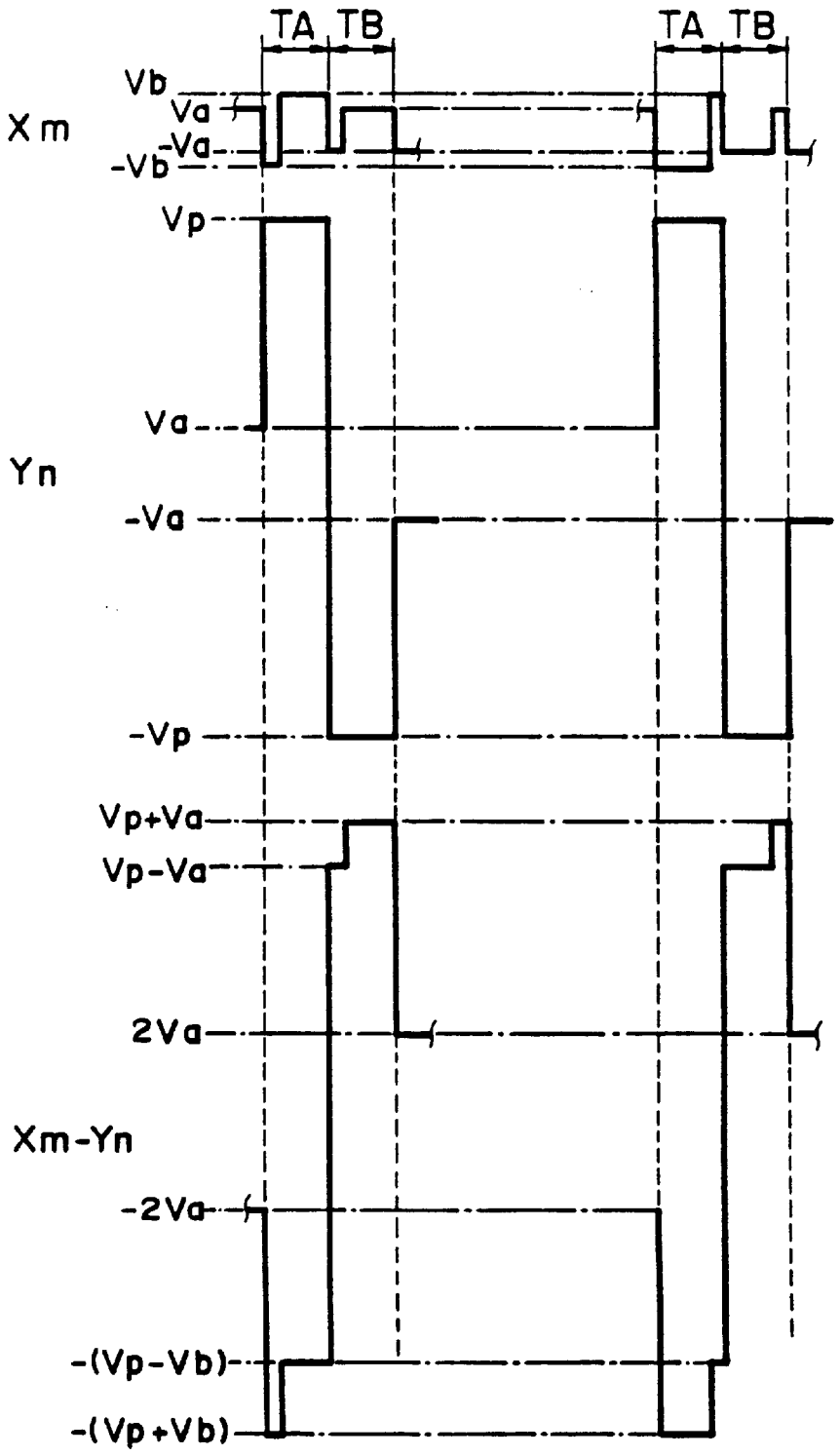
FIG. 31 is a drive waveform diagram of a liquid crystal panel in accordance with a sixth embodiment of the present invention.

An improved version of the column electrode signal Xm of FIG. 25, which shows the waveforms of the fourth embodiment, is shown in FIG. 31. In this figure, the reference potentials Vb and −Vb during the compensatory selection are set with respect to reference potentials Va and −Va of the column electrode signal Xm during the actual selection such that |Vb|>|Va|. In the example shown in FIG. 31, even when the amplitude of the row electrode signal Yn changes by 2×Vp, the potential of the difference signal Xm−Yn during the compensatory selection is made relatively greater than that during the actual selection.

Figure 32:
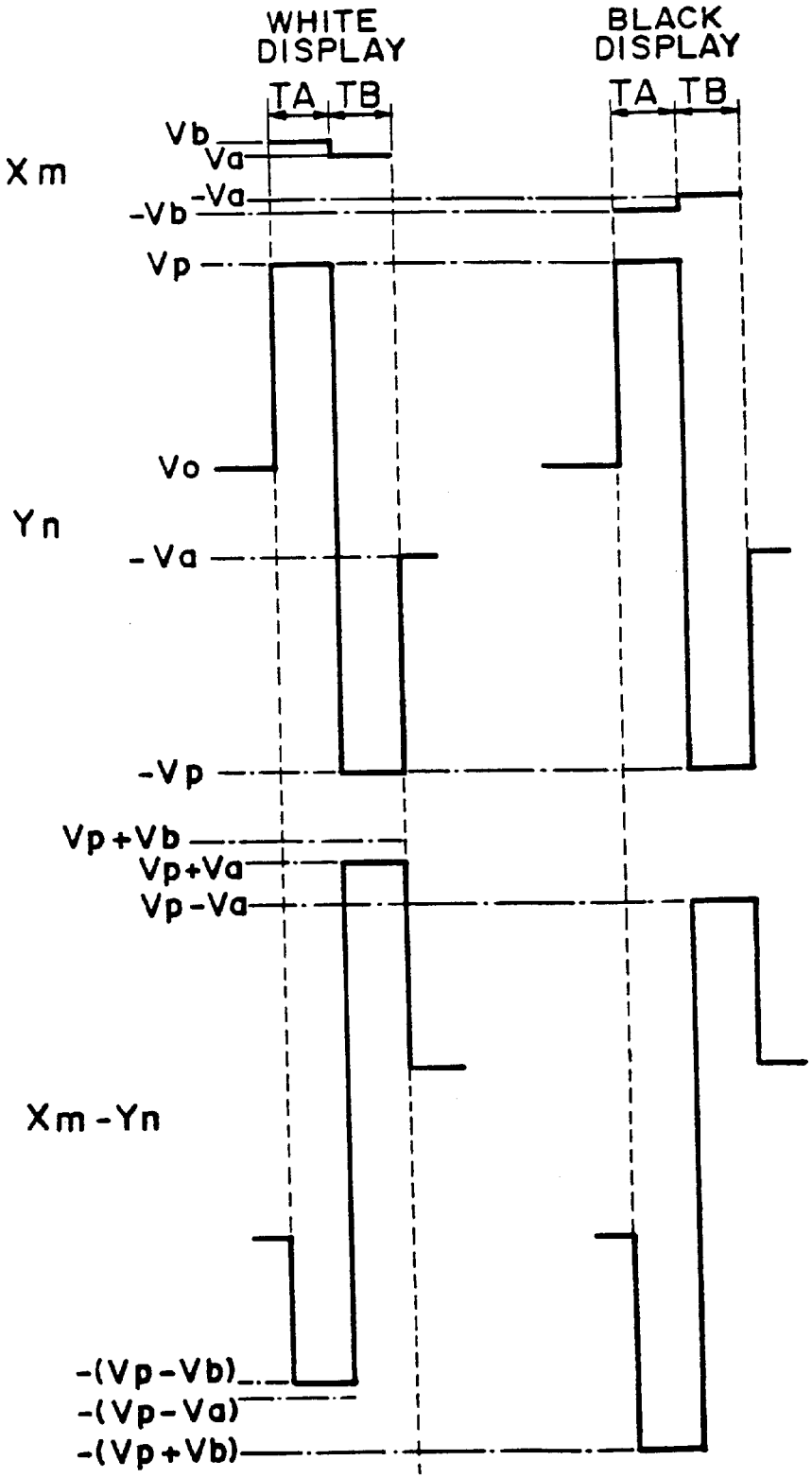
FIG. 32 is another drive waveform diagram of the liquid crystal panel in accordance with the sixth embodiment of the present invention.

Similarly, improved versions of the column electrode signal Xm and row electrode signal Yn of FIG. 19, which shows the waveforms of the second embodiment, are shown in FIG. 32. In this figure too, the reference potentials Vb and −Vb during the compensatory selection are set with respect to reference potentials Va and −Va of the column electrode signal Xm during the actual selection such that |Vb|>|Va|. The description based on FIG. 32 refers to white display (corresponding to the left-hand side of the figure). In order to show a white display by the pixels, the write potential is at a maximum of |Vp+Va| during the actual selection. In this case, the potential of the compensating voltage is |Vr−Vb| which is the minimum potential, because it is necessary to write the complementary data to the selection data at the compensatory selection. Conversely, when the pixels show a black display (corresponding to the right-hand side of the figure), the write potential for the actual selection is at a minimum at |Vp−Va| and the compensatory selection is at a maximum potential of |Vr+Vb|. Therefore, when white is selected, a large potential is applied to the non-linear element during the actual selection, but the non-linear element is subjected to only a small potential in the preceding compensatory selection. Conversely, when black is selected, the potential in the actual selection is small, but a large potential is applied to the non-linear element during the compensatory selection. In other words, this means that the total potential applied to the non-linear element can be made the same, regardless of whether black or white is selected.

Figure 33:
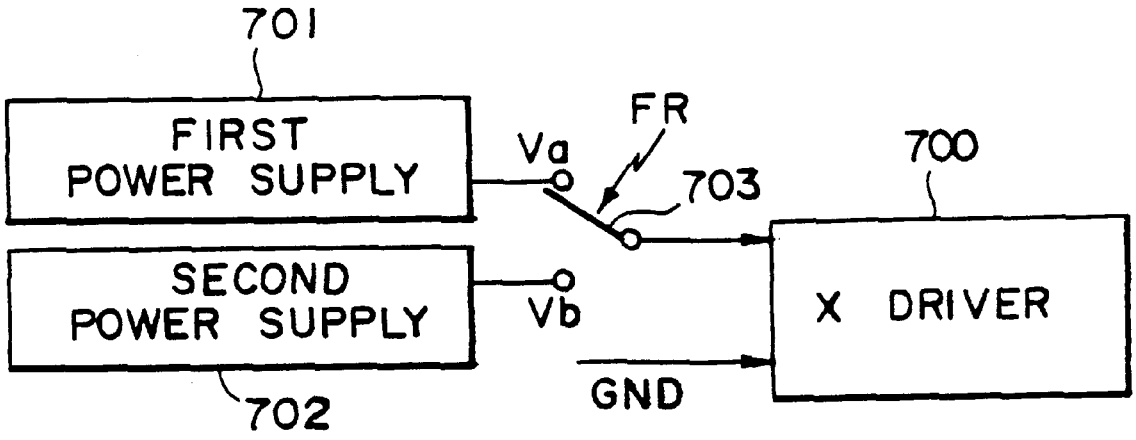
FIG. 33 is a diagram used to illustrate how the X driver of FIG. 31 and FIG. 32 generates the column electrode signal.

An example of the configuration of the drive circuit on the row electrode side is shown in FIG. 33. In this figure, the drive circuit is provided with a first power supply 701 for setting the reference voltage Va during the actual selection as the power voltage for the X driver 700, and a second power supply 702 for setting the reference voltage Vb during the compensatory selection. The configuration is such that power is supplied to the X driver 700 by the switching of the two supplies by a switch 703 that operates based on the AC inversion signal FR. In this case, the configuration could be such that relatively low voltages are supplied, such as about 5 V by the first power supply 701 and about 6 V by the second power supply 702.

In contrast, when the potential during the compensatory selection of the row electrode signal Yn is set to be greater than that during the actual selection, as in the second embodiment of the present invention, the power supply voltage connected to the Y driver must be large. This is particularly necessary when an MIM element is used as the non-linear element, because an MIM element needs a much larger voltage such as 30 to 40 V, and setting an even larger voltage on top of that will increase the load. It is possible to enable a liquid crystal drive circuit that uses an MIM element to obtain such a large voltage as 30 to 40 V by swinging a lower voltage to generate a large voltage, but it is difficult to accurately generate the potential Vr for the complementary selection by a voltage swing with respect to the potential Vp necessary during the actual selection shown in FIG. 19. Therefore, an X driver that can set a difference signal which has a larger potential in the compensatory selection than that in the actual selection can be formed simply by adding a power source of a relatively low voltage, and thus is it possible to accurately set a high voltage, with a drive circuit of a simple configuration.

Note that the first to sixth embodiments of the present invention have been described as having compensatory selection data in a period TA and actual selection data in a period TB, obtained by a difference signal Xm−Yn, which are in a mutually complementary relationship, but the present invention is not limited thereto. For instance, the complementary relationship need not hold, so long as the relationship is such that, when the data write charge voltage that charges the liquid crystal layer 113 during the actual selection is large, the compensatory charge voltage applied to the liquid crystal layer 113 during the compensatory selection is small and, conversely, when the data write charge voltage is small, the compensatory charge voltage is large. So long as this relationship between the actual selection data and the compensatory selection data holds, the afterimage phenomenon can be controlled.

In addition, the first to sixth embodiments of the present invention can also be carried out with polarity inversion techniques at every line that drive the device in such a manner that the polarity of the voltage charged into the liquid crystal layers of pixels in odd-numbered frames, for instance, is different from the polarity of the voltage that charges the liquid crystal layers of pixels in even-numbered frames.

Seventh Embodiment

Figure 34:
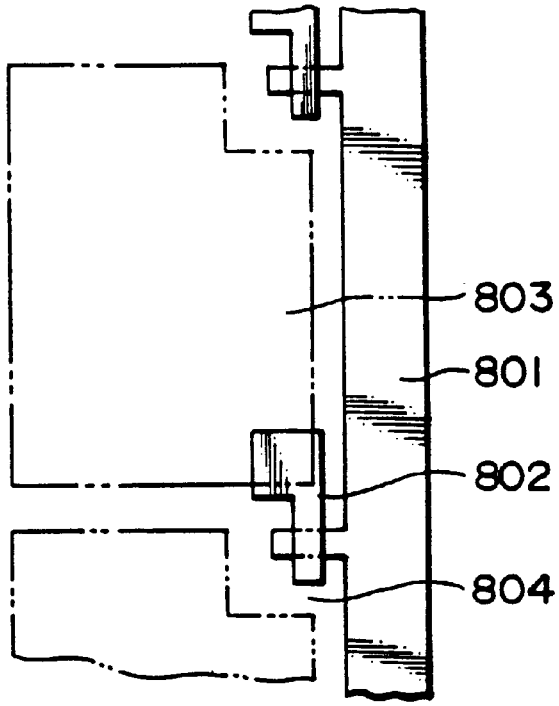
FIG. 34 is a plan view of a non-linear element of a seventh embodiment of the present invention.

A plan view of the non-linear element (denoted by reference number 114 in FIG. 1 and FIG. 11) of one pixel in a liquid crystal panel that uses a seventh embodiment of the present invention is shown in FIG. 34. In this figure, an MIM element using tantalum-tantalum oxide-chromium as materials is used as the non-linear element, and reference number 801 denotes a tantalum covered with tantalum oxide that also serves as a column electrode. Reference number 802 denotes chromium patterns. An MIM element is formed at an intersection between chromium patterns 802 and tantalum 801. Reference number 803 denotes a transparent ITO pattern that forms a pixel electrode.

Figure 35:
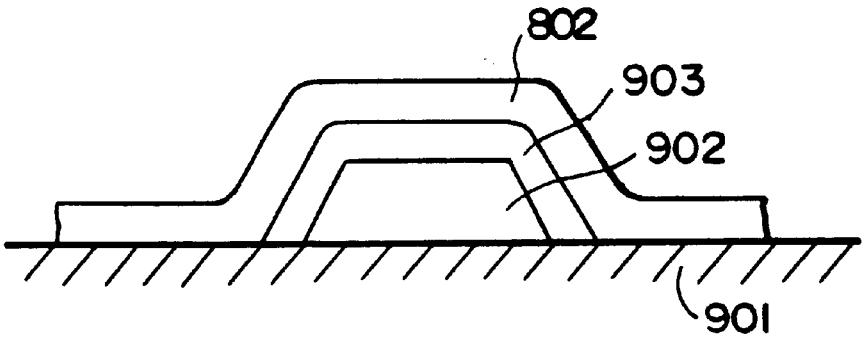
FIG. 35 is a cross-sectional view of the non-linear element of the seventh embodiment of the present invention.

FIG. 35 is a cross-sectional view through the structure of the MIM element, taken along the dot-dash line 804 in FIG. 34. Reference number 901 denotes a transparent substrate, reference number 902 denotes a tantalum portion, and reference number 903 denotes a tantalum oxide portion.

The method of fabricating the MIM element of this configuration will now be described.

A tantalum layer is formed on the transparent substrate by sputtering, and this layer is patterned to form a tantalum electrode that will be the column electrode. This tantalum electrode is subjected to anodic oxidization to cover the surface thereof with tantalum oxide. A diluted aqueous solution of phosphoric acid is used as the electrolyte for the anodic oxidization.

An oxide layer of a uniform thickness is obtained by initially controlling the current, then by applying a constant voltage. Subsequently, a chromium layer is sputtered and patterned, then ITO that is to form a transparent pixel electrode is also sputtered and patterned thereon. This enables the formation of an electrode substrate having MIM element. A liquid crystal panel can be formed by pasting this substrate together with a substrate formed of a resistance electrode, with a liquid crystal inserted into a gap therebetween.

Figure 8:
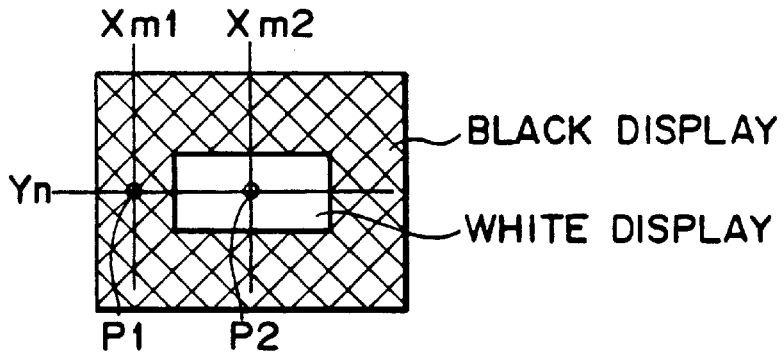
FIG. 8 PRIOR ART
FIG. 8 shows a window being displayed on a liquid crystal panel.
Figure 9:
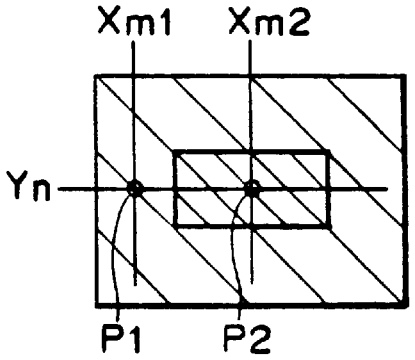
FIG. 9 PRIOR ART
FIG. 9 shows an intermediate display on a liquid crystal panel.
Figure 36:
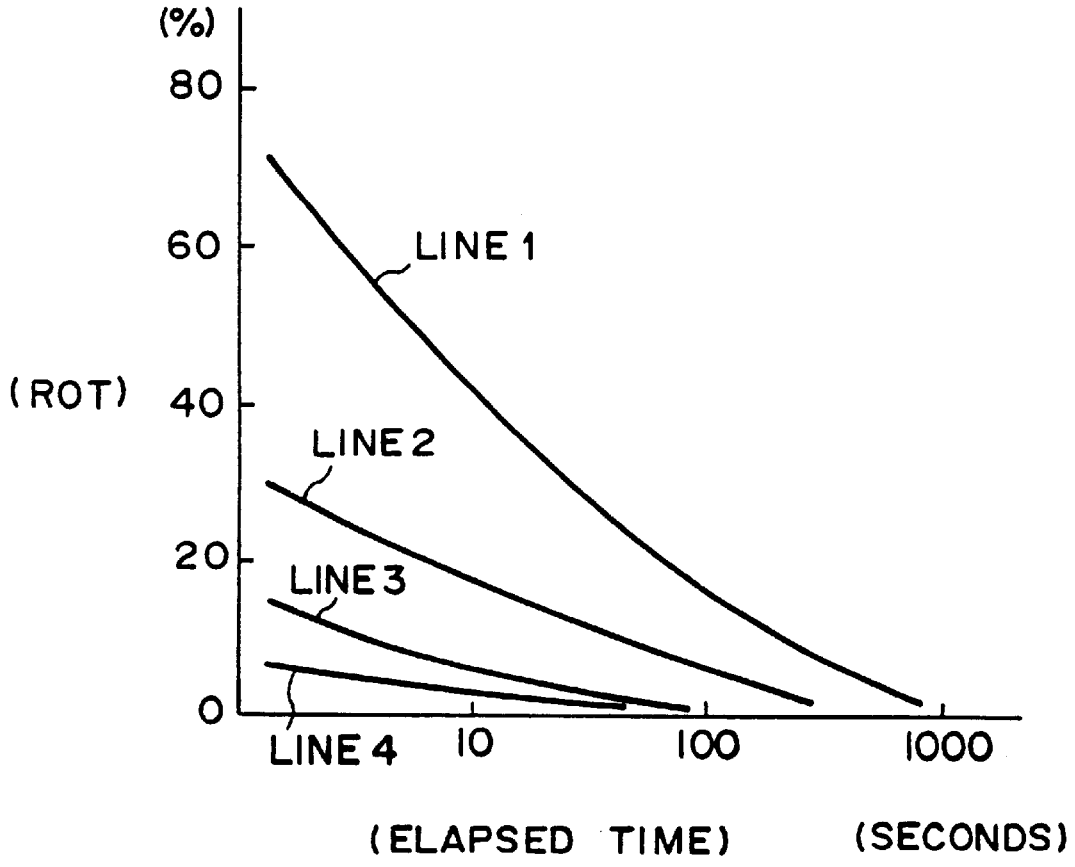
FIG. 36 is a graph of measurements taken of afterimage levels in the seventh embodiment of the present invention and an example of the prior art.

FIG. 36 is a graph of measurements done on the magnitude of afterimages in the present embodiment These measurements were done after the window display of FIG. 8 had been left on the liquid crystal panel for a fixed time then the entire panel was switched to the uniform display shown in FIG. 9. This graph shows variations in brightness ratio for the points P1 and P2 in FIG. 9.

Elapsed time after the display is switched to the uniform display is shown along the X-axis on a logarithmic scale, and the Y-axis shows RΔT when the brightnesses of the points P1 and P2 are TP1 and TP2, respectively, where RΔT expresses the degree of brightness ratio and is defined as:

$$R\Delta T=|TP1-TP2|/TP2\times 100$$

If a prior art drive method is defined as a, the drive method described as the third embodiment of the present invention is A, a device using a liquid crystal panel formed by a prior art anodic oxidization method is b, and a device using a liquid crystal panel formed by the anodic oxidization method of the seventh embodiment is B, the change in brightness ratio obtained by a combination of a and b is shown as line 1, that for a and B is line 2, that for A and b is line 3, and that for A and B (completely in accordance with the present invention) is line 4. Results obtained by comparison with functional tests show that, if the brightness ratio RΔT is in general initially 8% or less, afterimages cannot be discerned. Actual tests with display devices in accordance with embodiments of the present invention in comparison with prior art devices have proved that, provided fixed patterns were not held on display for excessively long times, afterimages could not be discerned.

By forming the insulator layer that will become a non-linear resistance element by anodic oxidization using an electrolytic liquid that includes phosphorus, it is possible to greatly reduce the magnitude of the I-V characteristic shift in comparison with a prior art non-linear element. This phenomenon has been confirmed by experimental results, but the mechanism thereof has not yet been clarified. It is assumed that perhaps the inclusion of phosphorus in an oxide film stabilizes the ranking of impurities existing within the film, and thus the current flowing therethrough is also stabilized by the Poole-Frenkel effect or Schottky effect. Note that the insulator layer described above would have the same effect if it is the insulator layer of an MIS element. Note also that if one of the metal layers of an MIM element is formed as transparent electrode layer, it can also be used as a transparent electrode of the liquid crystal panel.

What is claimed is:

1. A method of driving a liquid crystal display device that comprises a plurality of first electrodes to which a scanning signal is applied, a plurality of second electrodes to which a data signal is applied, and a plurality of pixels formed by intersecting said first and second electrodes, each of said pixels comprising a liquid crystal layer and a two-terminal element having non-linear resistance characteristics connected in series therewith, said method comprising the steps of:

(a) applying a write voltage to each of said pixels based on a difference signal between said scanning signal and said data signal during a data write period TB in which each of said first electrodes is selected and said liquid crystal layer of each of said pixels is charged with a data charge voltage corresponding to said data signal;

(b) applying a hold voltage of an absolute value smaller than said write voltage to each of said pixels based on said difference signal during a data hold period after said data write period TB; and (c) applying a compensatory voltage to each of said pixels during a compensatory period TA based on said difference signal before said data write period TB, a compensatory charge voltage applied to the liquid crystal layer has a polarity opposite to a polarity of said data charge voltage and is charged into said liquid crystal layer of each of said pixels, said compensatory charge voltage being set to have a relationship with said data charge voltage such that an absolute value of said compensatory charge voltage is small if said data charge voltage is large, but large if said data charge voltage is small.

2. A method of driving a liquid crystal display device in accordance with claim 1, wherein said compensatory charge voltage is substantially in a complementary relationship with said data charge voltage.

3. A method of driving a liquid crystal display device in accordance with claim 1, wherein a time ratio of said compensatory period TA to said data write period TB is set to be such that a load of a voltage applied to each of said two-terminal elements in said periods TA and TB becomes substantially equal for each of said two-terminal elements of said pixels.

4. A method of driving a liquid crystal display device in accordance with claim 1, wherein a potential of said scanning signal in said compensatory period TA is different from that in said data write period TB, each of said potentials being set so that a load of the voltage applied to each of said two-terminal elements in said periods TA and TB becomes substantially equal for each of said two-terminal elements of said pixels.

5. A method of driving a liquid crystal display device in accordance with claim 1, wherein a potential of said data signal in said compensatory period TA is different from that in said data write period TB, each of said potentials being set so that a load of the voltage applied to said each of said two-terminal elements in said periods TA and TB becomes substantially equal for each of said two-terminal elements of said pixels.

6. A method of driving a liquid crystal display device in accordance with claim 1, wherein said compensatory period TA and said data write period TB represent a first part and a second part of one horizontal scanning HS satisfying the following formula:

$$TA/(TA+TB)\leqq 1/4.$$

7. A method of driving a liquid crystal device in accordance with claim 1, wherein said compensatory period TA is overlapped with a flyback period of a video signal used for generating said scanning and said signal on a time axis.

8. A method of driving a liquid crystal display device in accordance with claim 1, wherein said data signal is set to a voltage corresponding to a gray scale and is also at a same voltage level within said period TA and said period TB immediately after said period TA; and a potential of said scanning signal is set to be such that polarities of voltages which are charged into said liquid crystal layer in said period TA and in said period TB are different.

9. A method of driving a liquid crystal display device in accordance with claim 8, wherein a time ratio of said period TA to said period TB is set so that a load of the voltage applied to each of said two-terminal elements in said periods TA and TB becomes substantially equal for each of said two-terminal elements of said pixels.

10. A method of driving a liquid crystal display device in accordance with claim 9, wherein said scanning signal is set to have potential such that the absolute values thereof in said periods TA and TB with respect to a middle potential of said data signal are substantially equal, and the period TA has a longer duration than the period TB.

11. A method of driving a liquid crystal display device in accordance with claim 8, wherein an absolute value of a potential of said scanning signal with respect to a middle potential of said data signal is set to be different in each of said periods TA and TB, and each of said potentials is set so that a load of the voltage applied to each of said two-terminal elements in said periods TA and TB becomes substantially equal for each of said two-terminal elements of said pixels.

12. A method of driving a liquid crystal display device in accordance with claim 11, wherein time widths of said periods TA and TB are substantially equal, and if the voltage of the scanning signal in said period TA with respect to said middle potential of the data signal is VTA and the voltage of the scanning signal in said period TB with respect to said middle potential is VTB, said voltages VTA and VTB are set such that:

$$|VTA|>|VTB|.$$

13. A method of driving a liquid crystal display device in accordance with claim 1, wherein a potential of said scanning signal is set to be such that polarities of voltages which are charged into said liquid crystal layer in said period TA and in said period TB are different;

in said period TB, said data signal is set to a voltage corresponding to a display gradation, and in said period TA, said data signal is set to a voltage of an absolute value that is greater than a voltage of said data signal in said period TB with respect to a middle potential of said data signal; and a load of the voltage applied to each of said two-terminal elements in said periods TA and TB becomes substantially equal for each of said two-terminal elements of said pixels.

14. A method of driving a liquid crystal display device in accordance with claim 13, wherein absolute values of said scanning signal with respect to said middle potential in said periods TA and TB are set to be equal.

15. A method of driving a liquid crystal device in accordance with claim 1, wherein said scanning signal is set to be such that polarities of voltages which are charged into said liquid crystal layer in said period TA and in said period TB are different;

said data signal has a potential Von that supplies a voltage of a large absolute value to each of said pixels or a potential Voff that supplies a voltage of a small absolute value thereto in relation to a potential of said scanning signal in said data write period TB, said data signal being supplied as a pulse-width modulation signal that varies a pulse width of said potential Von in said data write period TB to correspond with said voltage that is charged into said liquid crystal layer of each of said pixels, said data signal having said potential Von or said potential Voff in said period TA; and a duty factor of the pulse width of said potential Von in said period TA is substantially equal to a duty factor of the pulse width of said potential Von in said period TB.

16. A method of driving a liquid crystal display device in accordance with claim 15, wherein said difference signal has a period ToffA which corresponds to the pulse width of said potential Von of said data signal in said period TA, a period TonA which is the rest of said period, a period TonB which corresponds to the pulse width of said potential Von of said data signal in said period TB, and a period ToffB which is the rest of said period TB, the ratios TonA/TA and TonB/TB being substantially in a complementary relationship.

17. A method of driving a liquid crystal display device in accordance with claim 16, wherein a time ratio of said period TA to said period TB is set so that a load of the voltage applied to each of said two-terminal elements in said periods TA and TB becomes substantially equal for each of said two-terminal elements of said pixels.

18. A method of driving a liquid crystal display device in accordance with claim 16, wherein an absolute value of the potential of said scanning signal with respect to a middle potential between said potentials Von and Voff is set to be different in each of said periods TA and TB, and each of said potentials of said scanning signal is set so that a load of the voltage applied to each of said two-terminal elements in said periods TA and TB becomes substantially equal for each of said two-terminal elements of said pixels.

19. A method of driving a liquid crystal display device in accordance with claim 16, where an initial period of said period TA is said period ToffA and an ending period of said period TA is said period TonA, and an initial period of said period TB is said period ToffB and an ending of said period TB is said period TonB.

20. A method of driving a liquid crystal display device in accordance with claim 16, wherein an initial period of said period TA is said period TonA and an ending period of said period TA is said period ToffA, and said initial period of said period TB is said period ToffB and an ending period of said period TB is said period TonB.

21. A method of driving a liquid crystal display device in accordance with claim 1, wherein a potential of said scanning signal is set to be such that polarities of voltages which are charged into the liquid crystal in said period TA and in said period TB are different;

said data signal has a potential VonB that supplies a voltage of a large absolute value to each of said pixels or a potential VoffB that supplies a voltage of a small absolute value thereto in relation to a potential of said scanning signal, said data signal being supplied as a pulse-width modulation signal that varies the pulse width of said potential VonB in said period TB to correspond with said voltage that is charged into said liquid crystal layer of each of said pixels, said data signal having a potential VonA or a potential VoffA in said period TA of absolute values greater than those of the corresponding potentials VonB or VoffB, respectively with respect to a middle potential of said data signal; and a duty factor of the pulse width of potential VonA to said period TA is substantially equal to a duty factor of the pulse width of potential VonB to said period TB.

22. A method of driving a liquid crystal display device n accordance with claim 21, wherein said difference signal has a period ToffA which corresponds to the pulse width of said potential VonA of said data signal in said period TA, a period TonA which is the rest of said period TA, a period TonB corresponds to the pulse width of said potential VonB of said data signal in said period TB, and a period ToffB which is the rest of said period TB, the ratios TonA/TA and TonB/TB being substantially in a complementary relationship.

23. A method of driving a liquid crystal display device in accordance with claim 22, wherein a time ratio of said period TA to said period TB is set so that a load of the voltage applied to each of said two-terminal elements in said periods TA and TB becomes substantially equal for each of said two-terminal elements of said pixels.

24. A method of driving a liquid crystal display device in accordance with claim 22, wherein an initial period of said period TA is said period ToffA and an ending period of said period TA is said period TonA, and an initial period of said period TB is said period ToffB and an ending period of said period TB is said period TonB.

25. A method of driving a liquid crystal display device in accordance with claim 24, wherein an initial period of said period TA is said period TonA and an ending period of said period TA is said period ToffA, and said initial period of said period TB is said period ToffB and an ending period of said period TB is said period TonB.

26. A method of driving a liquid crystal display device in accordance with claim 1, wherein said two-terminal element has a metal-insulator-metal layer structure or a metal-insulator-semiconductor layer.

27. A method of driving a liquid crystal display device in accordance with claim 26, wherein an oxide film formed by anodic oxidation in an electrolytic liquid including phosphorus in a form such as phosphoric acid or ammonium phosphate is used as an insulator of said two-terminal element.

28. A method of driving a liquid crystal display device in accordance with claim 27, wherein said insulator is formed by anodic oxidation of tantalum.

29. A method of driving a liquid crystal display device in accordance with claim 26, wherein one of the metal layers of said metal-insulator-metal layer structure is a transparent conductive layer.

30. A method of driving a liquid crystal display device in accordance with claim 26, wherein an insulator layer of the metal-insulator-metal layer structure comprises silicone-nitride.

31. A method of driving a liquid crystal display device which comprises a plurality of column lines, a plurality of row lines and a plurality of pixels, each of said pixels including a display element and a non-linear resistance element connected in series between each of said column lines and said row lines, said method of driving the liquid crystal display device comprising the steps of:

applying a first voltage between each of said column lines and each of said row lines so that a display data is supplied to said display element of each of the pixels, in a data writing period of the pixels;

applying a lower voltage than said first voltage between each of said column lines and each of said row lines, in a data non-writing period of the pixels after said data writing period;

applying a second voltage higher than said lower voltage between each of said column lines and each of said row lines, in a compensatory period of the pixel before said data writing period and after said data non-writing period, wherein said second voltage in said compensatory period has a polarity opposite to that of said first voltage in said data writing period, a RMS of said second voltage in said compensatory period and a RMS of said first voltage in said data writing period are in a relation where:

the RMS of said second voltage is large when the RMS of said first voltage is small, and the RMS of said second voltage is small when the RMS of said first voltage is large.

32. A method of driving a liquid crystal display device in accordance with claim 31, wherein the RMS of said first voltage in said data writing period and the RMS of said second voltage in said compensatory period are substantially in a complementary relationship with each other.

33. A method of driving a liquid crystal display device in accordance with claim 32, wherein a sum of the RMS of said first voltage and said second voltage in said data writing and compensatory periods is set to be such that the RMS of a voltage applied to said non-linear resistance elements of the pixels in said data writing and compensatory periods is substantially made equal.

34. A method of driving a liquid crystal display device that comprises a plurality of column lines, a plurality of row lines and a plurality of pixels including a display element and a non-linear resistance element connected in series between each of said column lines and row lines, said method of driving the liquid crystal display device comprising the steps of:

applying a scanning signal to each of said row lines, said scanning signal having a data writing voltage in a data writing period, a data holding voltage in a holding period after said data writing period and a compensatory voltage in a compensatory period before said data writing period;

applying a data signal to each of said column lines, said data signal having a pulse-width modulation signal, wherein absolute values of said data writing voltage and said data compensatory voltage are greater than an absolute value of said data holding voltage with respect to a middle potential of said data signal, said data writing voltage has a polarity different from that of said compensatory voltage with respect to the middle potential of said data signal, a first difference signal between said writing voltage of the scanning signal and said pulse-width modulation signal is applied to the pixel in said data writing period and a second difference signal between said compensatory voltage of the scanning signal and said pulse-width modulation signal is applied to the pixel in said compensatory period and a ratio of pulse duty of said pulse-width modulation signal in said compensatory period is large when a ratio of pulse duty of said pulse-width modulation signal in said data writing period is large, but small when a ratio of pulse duty of said pulse-width modulation signal in said data writing period is small, thereby a ratio of the pulse duty of said second difference signal is small when a ratio of pulse duty of said first difference signal is large, but large when a ratio of pulse duty of said first difference signal is small.

35. A method of driving a liquid crystal display device in accordance with claim 34, wherein a time-width of said compensatory period is made substantially equal to a time-width of said data writing period.

36. A method of driving a liquid crystal display device in accordance with claim 34, wherein a time-width of said compensatory period is shorter than a time-width of said data writing period.

37. A method of driving a liquid crystal display device in accordance with claim 35, wherein a ratio of pulse duty of said pulse width modulation signal in said compensatory period is the same as a ratio of pulse duty of said pulse-width modulation signal in said data writing period.

38. A method of driving a liquid crystal display device in accordance with claim 36, wherein a ratio of pulse duty of said pulse-width modulation signal in said compensatory period is the same as a ratio of pulse duty of said pulse-width modulation signal in said data writing period.

39. A method of driving a liquid crystal display device in accordance with claim 36, wherein said compensatory period TA and said data writing period TB satisfy the following formula:

$$TA/(TA+TB) \leqq 1/4.$$

40. A method of driving a liquid crystal display device which comprises a plurality of column lines, a plurality of row lines and a plurality of pixels including a display element and a non-linear resistance element connected in series between each of said column lines and row lines, said method of driving the liquid crystal display device comprising the steps of:

applying a scanning signal to each of said row lines, said scanning signal having a data writing voltage in a data writing period, a data holding voltage in a holding period after said data writing period and a compensatory voltage in a compensatory period before said data writing period;

applying a data signal to each of said column lines, said data signal being an analog signal having multiple potential levels, wherein absolute values of said data writing voltage and said compensatory voltage are greater than an absolute value of said data holding voltage width respect to a middle potential of said data signal, and said data writing voltage has a polarity different from that of said compensatory voltage with respect to the middle potential of said data signal, a first difference voltage between said writing voltage of the scanning signal and said data signal is applied to the pixel in said data writing period and a second difference voltage between said compensatory voltage of the scanning signal and said data signal is applied to the pixel in said compensatory period, an absolute value of said potential level of the data signal maintaining a same level in said compensatory period and said data writing period, thereby an absolute value of said second difference voltage is small when an absolute value of said first difference voltage is large, but large when an absolute value of said first difference voltage is small.

41. A method of driving a liquid crystal display device in accordance with claim 40, said data writing voltage being substantially equal to said compensatory voltage with respect to the middle potential of said data signal.

42. A method of driving a liquid crystal display device in accordance with claim 40, said data writing voltage being different from said compensatory voltage with respect to the middle potential of said data signal.

43. A method of driving a liquid crystal display device which comprises a plurality of column lines, a plurality of row lines and a plurality of pixels including a display element and a non-linear resistance element connected in series between each of said column lines and row lines, said method of driving the liquid crystal display device comprising the steps of:

applying a scanning signal to each of said row lines, said scanning signal having a data writing voltage in a data writing period, a data holding voltage in a holding period after said data writing period and a compensatory voltage in a compensatory period before said data writing period;

applying a data signal to each of said column lines, wherein said data writing voltage and said compensatory voltage are greater than said data holding voltage with respect to a middle potential of said data signal, and said data writing voltage has a polarity different from that of said compensatory voltage with respect to the middle potential of said data signal, said compensatory period being overlapped by a flyback period of a video signal which said data signal is generated based on, wherein the following formula is satisfied:

$$TA/(TA+TB) \leqq 1/4,$$

where TA is said compensatory period and TB is said data writing period.

44. A method of driving a liquid crystal display device that comprises a plurality of first electrodes and a plurality of second electrodes, said first and second electrodes defining a plurality of pixels, each pixel comprising a series connection of a liquid crystal layer and a two-terminal element having a non-linear voltage-current characteristic, said series connection being connected between a respective one of said first electrodes and a respective one of said second electrodes, said method comprising:

applying a scanning signal to said first electrodes and a data signal to said second electrodes thereby applying a difference signal between said scanning signal and said data signal across each pixel, said difference signal including for each pixel:

a write period TB for selecting the pixel and charging the liquid crystal layer corresponding to the pixel in accordance with a data charge voltage applied based on said difference signal, said data charge voltage changing in accordance with the grey scale levels to be displayed, a hold period following said write period TB for applying an absolute value of said difference signal smaller than that during said write period, and a compensatory period TA preceding said write period TB and following a previous hold period, for charging said liquid crystal layer in accordance with a compensatory charge voltage applied based on said difference signal, wherein the polarity of said compensatory charge voltage is opposite to that of said data charge voltage and said compensatory charge voltage is varied so as to increase when said data charge voltage decreases and to decrease when said data charge voltage increases.

* * * * *